US005842254A

United States Patent [19]

Lee

[11] Patent Number: 5,842,254

[45] Date of Patent: Dec. 1, 1998

[54] DUAL MODE VACUUM CLEANER

[75] Inventor: Nam Ho Lee, Seoul, Rep. of Korea

[73] Assignee: Daewoo Electronics Co., Ltd., Seoul, Rep. of Korea

[21] Appl. No.: 615,968

[22] Filed: Mar. 14, 1996

[30] Foreign Application Priority Data

Mar. 31, 1995 [KR] Rep. of Korea ..... 95-7569
May 31, 1995 [KR] Rep. of Korea ..... 95-14211

[51] Int. Cl.[6] ..... A47L 5/12

[52] U.S. Cl. ..... 15/327.4; 15/327.2; 15/328; 403/325

[58] Field of Search ..... 15/328, 327.1, 15/327.2, 327.4, 377; 403/321, 322, 325

[56] References Cited

U.S. PATENT DOCUMENTS

| | | | |
|---|---|---|---|
| 2,769,998 | 11/1956 | Hunter | 15/327.4 |
| 2,974,344 | 3/1961 | Kemnitz | 15/327.4 |
| 3,310,828 | 3/1967 | Clark et al. . | |
| 3,883,922 | 5/1975 | Fleischhauer . | |
| 4,393,536 | 7/1983 | Tapp | 15/328 |
| 4,697,299 | 10/1987 | Brinkhoff et al. | 15/327.2 |
| 4,996,737 | 3/1991 | Madru | 15/328 |

FOREIGN PATENT DOCUMENTS

| | | | |
|---|---|---|---|
| 1165585 | 10/1958 | France . | |
| 616857 | 8/1935 | Germany . | |
| 40 3-237952 | 10/1991 | Japan | 15/327.1 |
| 2237982 | 5/1991 | United Kingdom | 15/327.1 |
| 2290462 | 1/1996 | United Kingdom . | |

*Primary Examiner*—Terrence Till
*Attorney, Agent, or Firm*—Beveridge, DeGrandi, Weilacher & Young, LLP

[57] ABSTRACT

Disclosed is a dual mode vacuum cleaner which can be used as both a canister mode cleaner and an upright mode cleaner. The cleaner can be easily converted from the canister mode to the upright mode or vice versa by simple handling. The cleaner has a body section including a pair of wheels, a dirt-collecting section for sucking air containing dirt, and a coupler assembly for detachably coupling the body section to the dirt-collecting section. In the cleaner, the conversion of the operating modes is achieved in the interior of the coupler assembly by the interaction of elements, so that elements do not protrude out of the coupler assembly, thereby giving the cleaner an improved external appearance. The coupler assembly has a firm internal structure so that the life span of the coupler assembly will be lengthened and its durability will improve.

19 Claims, 16 Drawing Sheets

DUAL MODE VACUUM CLEANER

BACKGROUND OF THE INVENTION

1. Field of the Invention

The present invention relates to a dual mode vacuum cleaner, and more particularly to a dual mode vacuum cleaner which can be used in a canister mode vacuum cleaner or, alternatively, in an upright mode vacuum cleaner, and which can be easily converted from the canister mode vacuum cleaner to the upright mode vacuum cleaner or vice versa by simple handling.

2. Prior Art

A vacuum cleaner is an electrical appliance for removing dirt such as dust from carpets or floorings by suction. Generally, the vacuum cleaner is classified into a canister mode cleaner and an upright mode cleaner.

In the canister mode vacuum cleaner, a cleaner body section and a brush section are separated from each other, so that the brush section can separately move with respect to the cleaner body section while cleaning. Therefore, even when dirt has collected on high places such as book shelves, the user can easily remove dirt by simply moving the brush section onto the book shelf without lifting the heavy cleaner body section.

However, since the cleaner body section is separated from the brush section, the canister mode vacuum cleaner may occupy a large space when operated or stored. In addition, since the user should separately move both the cleaner body section and the brush section while cleaning, it is difficult to use the canister mode vacuum cleaner in a narrow or a winding area.

In the upright mode vacuum cleaner, a cleaner body section and a brush section are formed integrally with each other, so that the brush section may move together with the cleaner body section while cleaning. Therefore, the upright mode vacuum cleaner does not occupy large space when stored or operated, and can be easily handled while cleaning.

However, since the cleaner body is formed integrally with the brush section, when it is necessary to clean high places such as book shelves, the user should manually lift the heavy cleaner body section as well as the brush section so as to remove dirt.

In order to compensate for the weak points in the above two-mode vacuum cleaners, various types of dual mode vacuum cleaners have been proposed, but they have presented many problems. For example, U.S. Pat. No. 4,393,536 of Tapp discloses a dual mode vacuum cleaner having a canister which can be operated in either a horizontal or substantially upright position.

However, the above U.S. patent does not disclose the construction and the shape of an attachment device for assembling the canister and a suction pipe with each other. Further it may be considerably difficult and time-consuming to assemble or disassemble the canister and the suction pipe with or from each other. Moreover, a dirt collecting chamber and a blow chamber are all defined in the canister. Accordingly, the canister has a relatively large volume and a relatively heavy weight, so that difficulties and time-consumption may further increase.

In the meantime, a dual mode vacuum cleaner, which can be easily converted from the canister mode vacuum cleaner to the upright mode vacuum cleaner by simple handling, has been filed by the applicant of the present invention and now is pending as U.S. patent application Ser. No. 08/366,718.

FIGS. 17 to 21 show the dual mode vacuum cleaner and elements thereof.

Referring to FIG. 18, dual mode vacuum cleaner 500 has a dirt-collecting section 200 which sucks dirt and collects it therein, a handle 400 connected to dirt-collecting section 200 in order to handle the movement of vacuum cleaner 500, and a cleaner body section 300 which is detachably connected to dirt-collecting section 200. As shown in FIG. 17, cleaner body section 300 includes a drum 320 in which a blower assembly (not shown) for generating suction force is accommodated, and a pair of wheels 310 which are disposed at both side walls of drum 320 respectively. Dirt-collecting section 200 is communicated with cleaner body section 300 by means of a flexible hose 250, so that air containing dirt is sucked into dirt-collecting section 200 through a brush head 210 disposed at the lower portion of dirt-collecting section 200.

As shown in FIG. 19, a pair of suspension canopies 610 are provided on the face of a rear wall 201 of dirt-collecting section 200. A coupler 650, which is disposed between dirt-collecting section 200 and cleaner body section 300 so as to detachably connect dirt-collecting section 200 to cleaner body section 300, is pivotally suspended by the pair of suspension canopies 610.

Referring again to FIG. 17, coupler 650 includes an upper case 651, a lower case 653 assembled into upper case 651, and a pair of levers 672 encased between lower and upper cases 651 and 653.

Coupler 650 also includes a pair of cylindrical heads 652 protruding outward from the upper end thereof. Each cylindrical head 652 is formed with a hinge pin 654 protruding outward from the outer side surface thereof so as to be hinged to suspension canopy 610.

Each lever 672 has a compression protuberance 673 at its upper end. In addition, an engagement protuberance 676 extending outward from the coupler 650 is formed at the lower end of coupler 650. Levers 672 are intercrossed with each other when they are assembled. A compression spring 678 is disposed between the lower ends of levers 672 so as to apply an outward biasing force to engagement protuberances 676.

Rear wall 201 has a pair of engagement brackets 620 which are fixed under suspension canopies 610 so as to correspond to compression protuberances 673. A leaf spring (not shown) is fixed at the inner surface of suspension canopy 610.

Meanwhile, drum 320 includes a receptacle 330 formed at the front face thereof. Receptacle 330 has two opposite engagement holes 332 which are formed in correspondence to engagement protuberances 676 in such a manner that engagement protuberances 676 can be inserted in engagement holes 332.

The conventional dual mode vacuum cleaner operates as follows.

Firstly, when vacuum cleaner 500 is used in the upright mode as shown in FIG. 20, coupler 650 is inserted in receptacle 330 of drum 320, and engagement protuberances 676 are fitted in engagement holes 332. In this case, coupler 650 can pivot about hinge pins 654, and the angle of vacuum cleaner 500 with respect to the ground may be easily converted by simply handling handle 400.

When it is required to convert the vacuum cleaner from the upright mode to the canister mode, the user places cleaner-body section 300 upright as shown in FIG. 18. In this case, coupler 650 is closely adjacent to rear wall 201 of dirt-collecting section 200, so that compression protuberances 673 are pushed into coupler 650 by the sliding contact between compression protuberances 673 and engagement brackets 620.

As compression protuberances 673 are pushed into coupler 650, engagement protuberances 676 which are formed at the lower ends of levers 672 are also pushed into coupler 650, so that compression protuberances 673 may be released from engagement holes 332, and thereby releasing coupler 650 from receptacle 330. Accordingly, cleaner body section 300 can easily separate from dirt-collecting section 200 so that vacuum cleaner 500 can be used in the canister mode.

When it is required to convert the vacuum cleaner from the canister mode to the upright mode again, the user places cleaner-body section 300 upright again as shown in FIG. 18. Then, coupler 650 is inserted in receptacle 330 of drum 320, and is pivoted upwards as shown in FIG. 20. In this case, compression protuberances 673, which have been pushed into coupler 650, are protruded out again by the bias force of compression spring 678. Accordingly, as shown in FIG. 21, engagement protuberances 676 are again inserted into engagement holes 332. Therefore, cleaner-body section 300 may be coupled to dirt-collecting section 200 again so that vacuum cleaner 500 can be used in the upright mode.

However, conventional dual mode vacuum cleaner 500 has the following disadvantages:

Firstly, since engagement bracket 620 protrudes outwardly from rear wall 201 of dirt-collecting section 200, there is a possibility that for engagement bracket 620 will collide with other structures while cleaning is being performed. As engagement bracket 620 repeatedly encounters such a collision, engagement bracket 620 may separate from rear wall 201 of dirt-collecting section 200, or, in an extreame case, may be broken. In this case, vacuum cleaner 500 can not be converted from the upright mode to the canister mode.

Furthermore, there is possibility that the pair of levers 672 and spring 678 may deviate from their initial positions when the strong collision happens.

SUMMARY OF THE INVENTION

The present invention has been made to overcome the above described problems of the prior arts, and accordingly it is an object of the present invention to provide a dual mode vacuum cleaner which can be used in a canister mode vacuum cleaner or, alternatively, in an upright mode vacuum cleaner, and which can be easily converted from the canister mode vacuum cleaner to the upright mode vacuum cleaner or vice versa by simple handling.

Another object of the present invention is provided a dual mode vacuum cleaner having a firm internal structure and an improved external appearance.

To achieve the above objects, the present invention provides a vacuum cleaner comprising:

- a cleaner body section including a drum and a pair of wheels provided at both side walls of the drum;
- a dirt-collecting section for sucking and collecting a dirt, the dirt-collecting section having a brush head at a lower portion thereof and being connected to the cleaner body section by a flexible hose;
- a first means for coupling the cleaner body section to the dirt-collecting section;
- a second means for separating the cleaner body section from the dirt-collecting section, the second means being incorporated with the first means; and
- a third means for securely setting the first means, so that the cleaner body section can be easily coupled to or separated from the dirt-collecting section.

According to the first embodiment of the present invention, the first means includes a receptacle which is formed at a front portion of the drum and provided at its lower side walls with an engagement hole respectively, and a coupler assembly received in the receptacle. The coupler assembly includes an upper case, a lower case assembled into the upper case, and a frame disposed between the upper case and lower case.

A lever assembly is accommodated in the coupler assembly. The lever assembly has a torsion spring including an annular portion and a pair of leg portions, a pair of sleeves securely engaged with the leg portions, and a pair of sliders having an insert hole thereon. The end parts of the leg portions are inserted in the insert holes of sliders respectively.

The second means includes a pair of protuberances having a slope portion at their front portion respectively, a pair of second guide holes formed in the lower case, and a pair of third guide holes formed in the frame. The pair of protuberances are integrally formed with the rear wall of the dirt-collecting section. The second and third guide holes are disposed in correspondence to the pair of protuberances so as to guide the protuberances into the coupler assembly.

The third means includes a pair of convex portions which are integrally formed at first cylindrical heads respectively, and a pair of leaf springs which are secured to the dirt-collecting section by a bolt and extended downward along the pair of first guide holes. Each leaf spring has a concave portion.

Meanwhile, according to the second embodiment of the present invention, the lever assembly includes an arm portion, a hinge pin which passes through the upper portion of the arm portion, a torsion spring which is closely wound around the hinge pin, and a slider connected to the torsion spring. The torsion spring has a first leg portion and second leg portion which is longer than the first leg portion.

The second means includes a pair of protuberances having a slope portion at their front portion respectively, a pair of guide holes formed in the lower case, and a slide-contact portion formed integrally with an lower portion of the arm portion. The pair of protuberances are integrally formed with the rear wall of the dirt-collecting section. Each leaf spring has a pair of concave portions.

When the vacuum cleaner is used in the upright mode, the coupler assembly is inserted in the receptacle of the drum. In this case, sliders are pushed outward and then inserted into engagement holes by means of biasing force of the torsion spring, so that the dirt-collecting section and the cleaner-body section are integrally coupled with each other (upright mode).

When it is required to convert the vacuum cleaner from the upright mode to the canister mode, the user places the vacuum cleaner upright. In this case, protuberances which are formed at the rear wall of the dirt-collecting section enter into the interior of the coupler assembly. Therefore, sliders which surround leg portions move toward a longitudinal axis of coupler assembly along an elongated guide groove, thereby releasing sliders from engagement holes.

Accordingly, it is possible to separate the coupler assembly from the receptacle, so that the user can use the vacuum cleaner in the canister mode.

As described above, the dual mode vacuum cleaner according to the present invention may be easily and rapidly converted from the canister mode to the upright mode by simple handling.

Further, since the conversion of the operating modes is achieved in the interior of the coupler assembly by the interaction of elements, elements do not protrude out of the coupler assembly thereby giving the vacuum cleaner an improved external appearance.

Furthermore, since the coupler assembly has a firm internal structure, the life span of the coupler assembly is lengthened and its durability is improved.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Hereinafter, several preferred embodiments of the present invention will be described in detail with reference to the accompanying drawings.

FIGS. 1 to 9 show a dual mode vacuum cleaner 100 and the elements thereof according to the first embodiment of the present invention.

Figure 1:
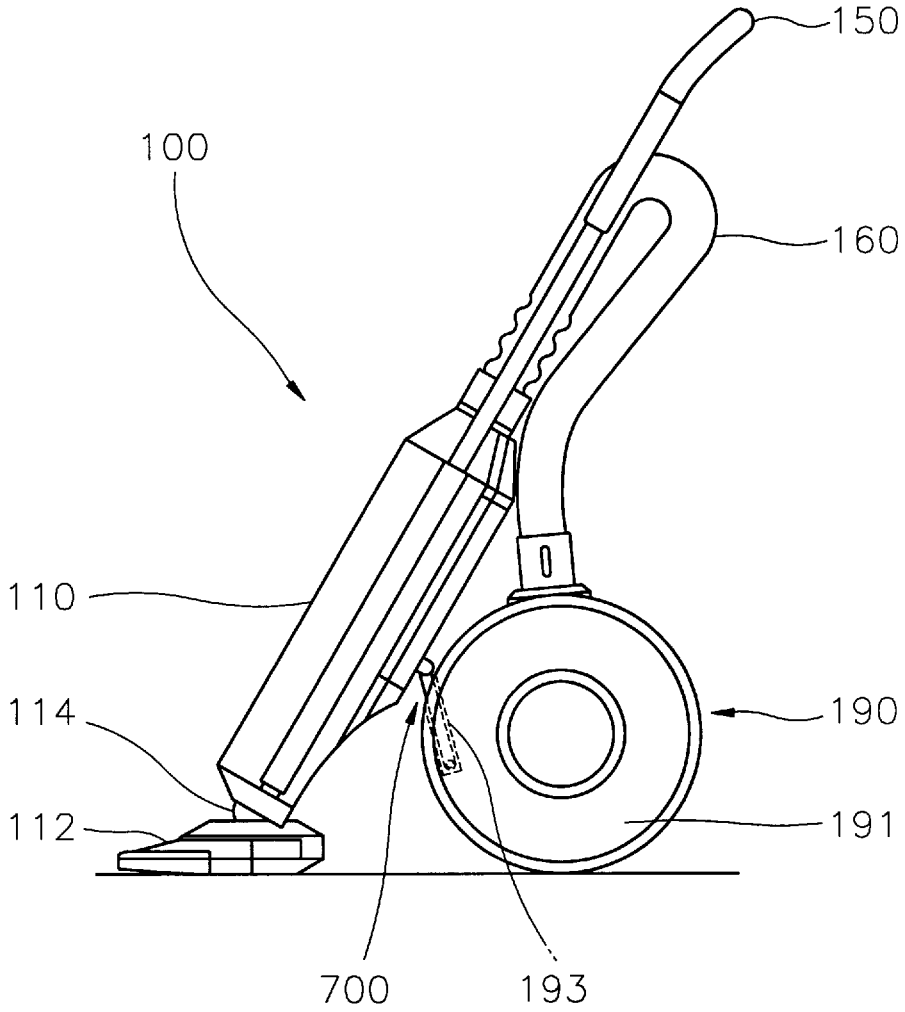
FIG. 1 is a side view of a dual mode vacuum cleaner in a canister mode according to the first embodiment of the present invention.

Referring to FIG. 1, dual mode vacuum cleaner 100 has a dirt-collecting section 110 which sucks dirt and collects it therein, a handle 150 connected to dirt-collecting section 110 in order to handle the movement of vacuum cleaner 100, and a cleaner body section 190 which is detachably connected to dirt-collecting section 110 by means of a coupler assembly 700. As partially shown in FIG. 3, cleaner body section 190 includes a drum 192 in which a blower assembly (not shown) for generating suction force is accommodated, and a pair of wheels 191 which are disposed at both side walls of drum 192, respectively. At the front of drum 192, there is formed a receptacle 193 for receiving coupler assembly 700. Dirt-collecting section 110 is communicated with cleaner body section 190 by means of a flexible hose 160, so that, when the blower assembly operates, air containing dirt is sucked into dirt-collecting section 110 through a brush head 112 disposed at the lower portion of dirt-collecting section 110. Handle 150 is coupled to dirt-collecting section 110 in such a manner that its height can be adjusted. Brush head 112 is rotatably coupled beneath dirt-collecting section 110 by means of a spherical universal joint 114. The height of handle 150 is adjusted by handling a push button 117 shown in FIG. 4.

Figure 5:
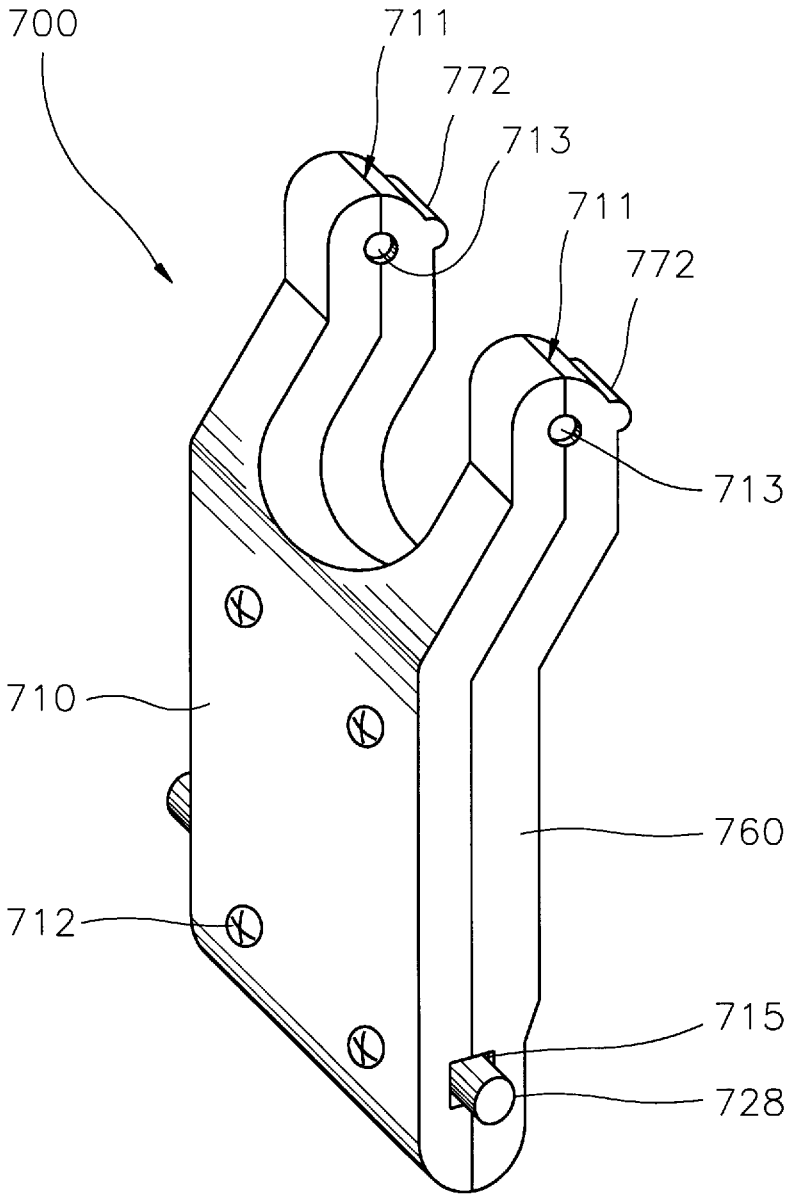
FIG. 5 is an enlarged perspective view of a coupler assembly according to the first embodiment of the present invention.
Figure 6:
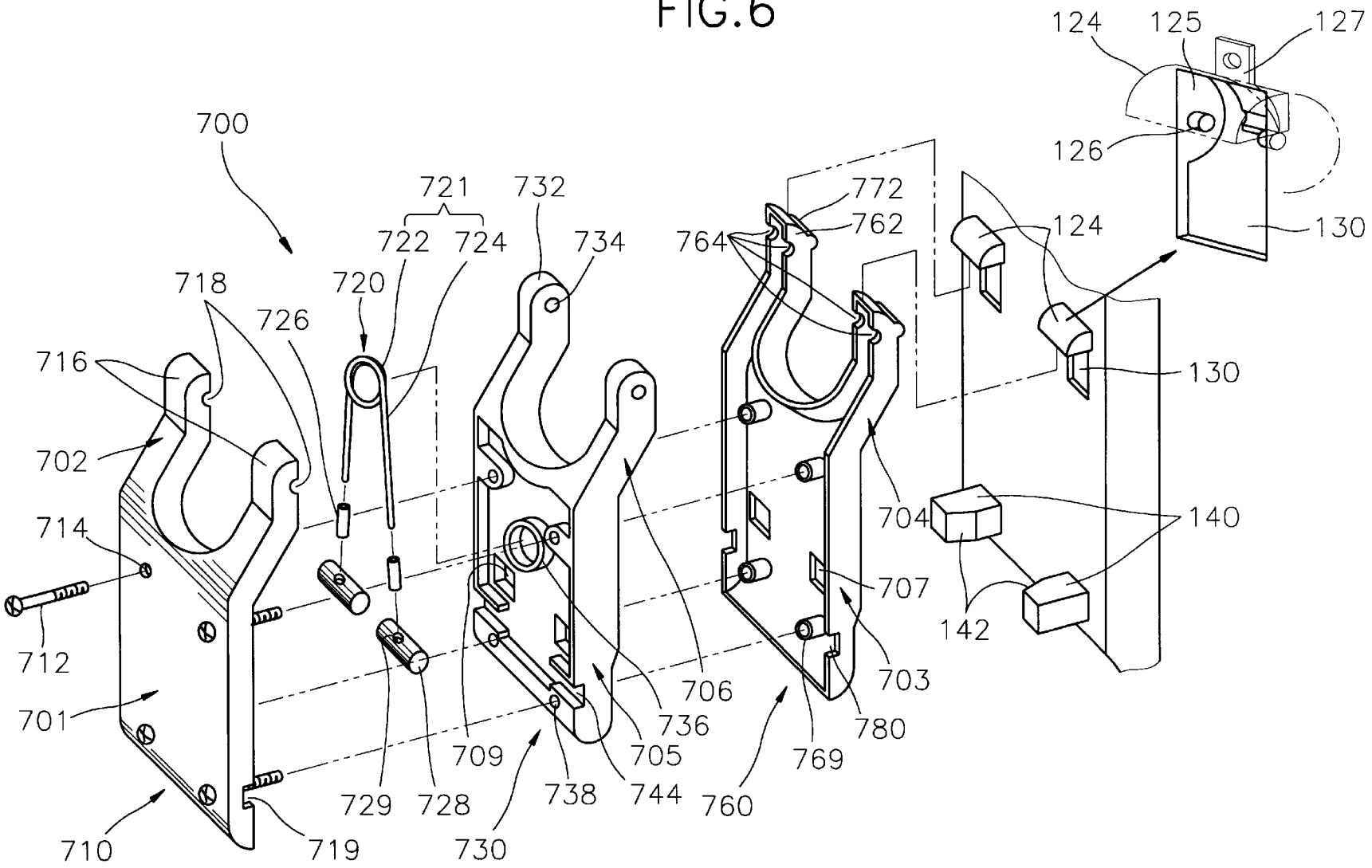
FIG. 6 is an exploded perspective view of the coupler assembly shown in FIG. 5.

Referring to FIGS. 5 and 6, dirt-collecting section 110 has a pair of first guide holes 130 at its rear wall. At the upper portion of each first guide hole 130, there are provided a pair of semi-circular suspension plates 125 which extend toward the interior of dirt-collecting section 110 in such a manner that they can face each other. Each semi-circular suspension plate 125 has a hinge pin 126, and coupler assembly 700 is pivotally suspended to dirt-collecting section 110 by hinge pin 126. In addition, an arc-shaped canopy 124 is provided just above each first guide hole 130, respectively. A pair of protuberances 140, which are inserted into or released from coupler assembly 700 when the operation mode is converted, are provided below the pair of first guide holes 130. Each protuberance 140 has a slope portion 142 at the lead end thereof, and is formed integrally with the rear wall of dirt-collecting section 110.

Coupler assembly 700 includes an upper case 710, a lower case 760 which is assembled with upper case 710 by bolts 712, a frame 730 disposed between upper case 710 and lower case 760, and a lever assembly 720 disposed between upper case 710 and frame 730. Upper case 710, frame 730, and lower case 760 have a similar shape.

Upper case 710 includes a first base portion 701, and a first fork portion 702 which is integrally formed at the upper portion of first base portion 701. First base portion 701 is formed with a plurality of first perforation holes 714 into which bolts 712 pass through. At the terminal end of first fork portion 702, there are provided a pair of first semi-cylindrical heads 716 having a pair of first semi-circular apertures 718, respectively. In addition, a first cutting portion 719 is formed at lower side walls of first base portion 701.

Lower case 760 includes a second base portion 703 and a second fork portion 704 which is integrally formed at the upper portion of second base portion 703. Second base portion 703 has a pair of second guide holes 707 which are disposed in correspondence to protuberances 140 in order to guide protuberances 140 into coupler assembly 700. At the inner surface of second base portion 703, there are provided a plurality of screw holes 769 which are disposed in correspondence to first perforation holes 714 in such a manner that bolts 712 passing through first perforation holes 714 can be screwed into screw holes 769. In addition, a second cutting portion 780 is formed at the lower portion of both side walls of second base portion 703. Second cutting portion 780 is incorporated with upper case 710 in order to form a rectangular hole 715.

Figure 3:
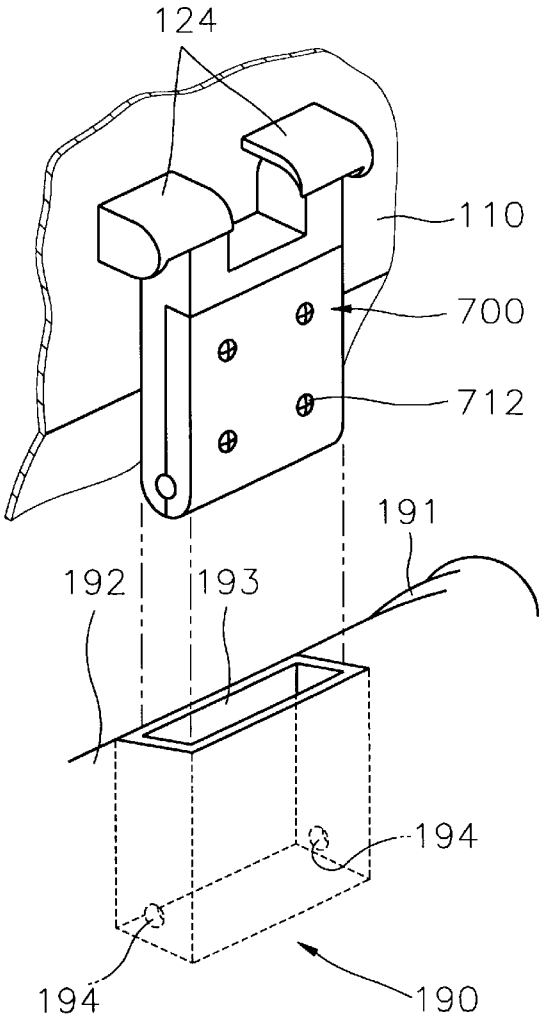
FIG. 3 is an enlarged view of a coupler assembly shown in FIG. 2.
Figure 8:
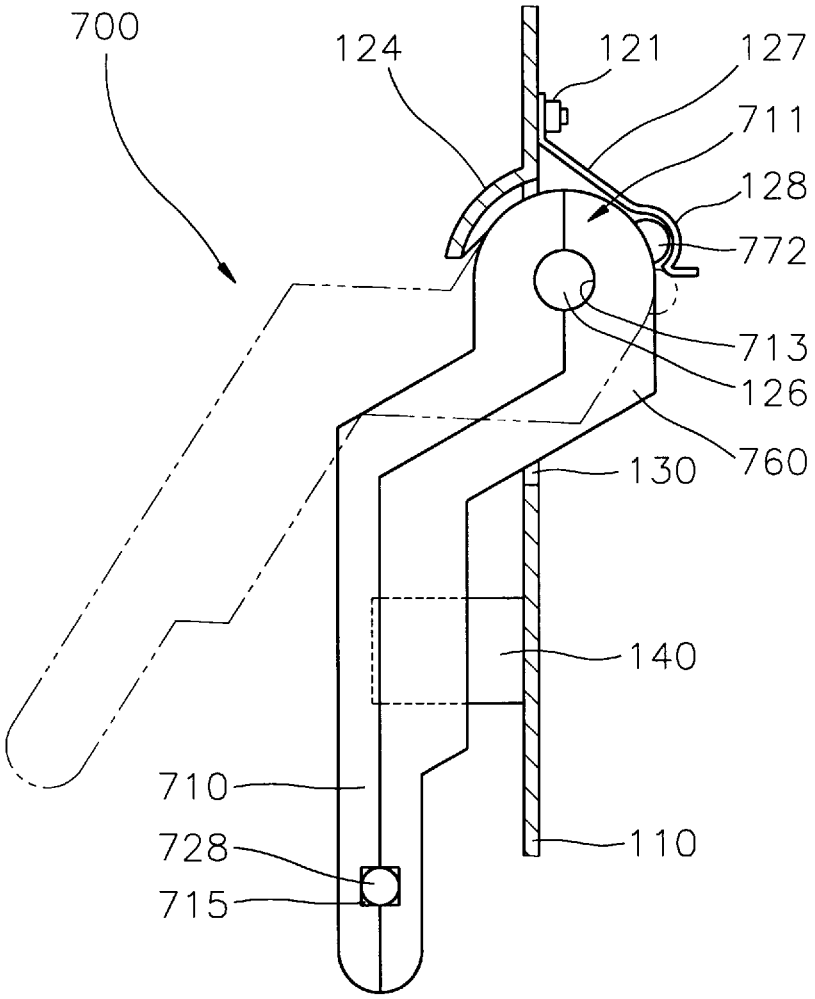
FIG. 8 is a side view of the coupler assembler mounted on the dirt-collecting section.

At the terminal end of second fork portion 704, there are provided a pair of second semi-cylindrical heads 762 having a pair of second semi-circular apertures 764 respectively. As shown in FIG. 5, the pair of second semi-cylindrical heads 762 are incorporated with the pair of first semi-cylindrical heads 716 in order to form a pair of first cylindrical heads 711, and the pair of second semi-circular apertures 764 are incorporated with first semi-circular apertures 718 in order to form a pair of first pin holes 713. As shown in FIG. 8, the pair of first cylindrical heads 711 are inserted into the pair of first guide holes 130 formed at dirt-collecting section 110, and are pivotally connected to dirt-collecting section 110 by hinge pin 126. In addition, a convex portion 772 is integrally formed with each second semi-cylindrical head 762. Since convex portion 772 is engaged with a concave portion 128 of a leaf spring 127 which is secured to dirt-collecting section 110 by a bolt 121, coupler assembly 700 can be secured parallel to the rear wall of dirt-collecting section 110 as shown in FIG. 3.

Frame 730 includes a third base portion 705 and a third fork portion 706 which is integrally formed at the upper portion of third base portion 705. Third base portion 705 has a plurality of second perforation holes 738 which are disposed in correspondence to first perforation holes 714 in such a manner that bolts 712 can pass therethrough. Third base portion 705 also has a protuberance ring 736 for suspending lever assembly 720. In addition, third base portion 705 has a pair of third guide holes 709 which are disposed in correspondence to the pair of third guide holes 709 so as to guide protuberances 140 thereto. At the lower portion of frame 730, there is formed an elongated guide groove 744 for guiding the movement of lever assembly 720. Elongated guide groove 744 is positioned in correspondence to rectangular hole 715.

At the terminal end of third fork portion 706, there are provided a pair of second cylindrical heads 732 having a pair of second pin holes 734 respectively. Second pin holes 734 communicate with first pin holes 713. As mentioned above, since hinge pins 126 formed at dirt-collecting section 110 is inserted into both first pin holes 713 and second pin holes 734, coupler assembly 700 can be pivotally coupled to dirt-collecting section 110.

First fork portion 702, second fork portion 704 and third fork portion 706 are declined at a predetermined angle with respect to first base portion 701, second base portion 703 and third fork portion 706, so that coupler assembly 700 which is inserted into first guide holes 130 may easily pivot about hinge pins 126. Although first guide holes 130, second guide holes 707, third guide holes 709, rectangular hole 715 and elongated guide groove 744 are illustrated as a rectangular shape in the drawings, their shape may vary according to the embodiments.

Figure 7:
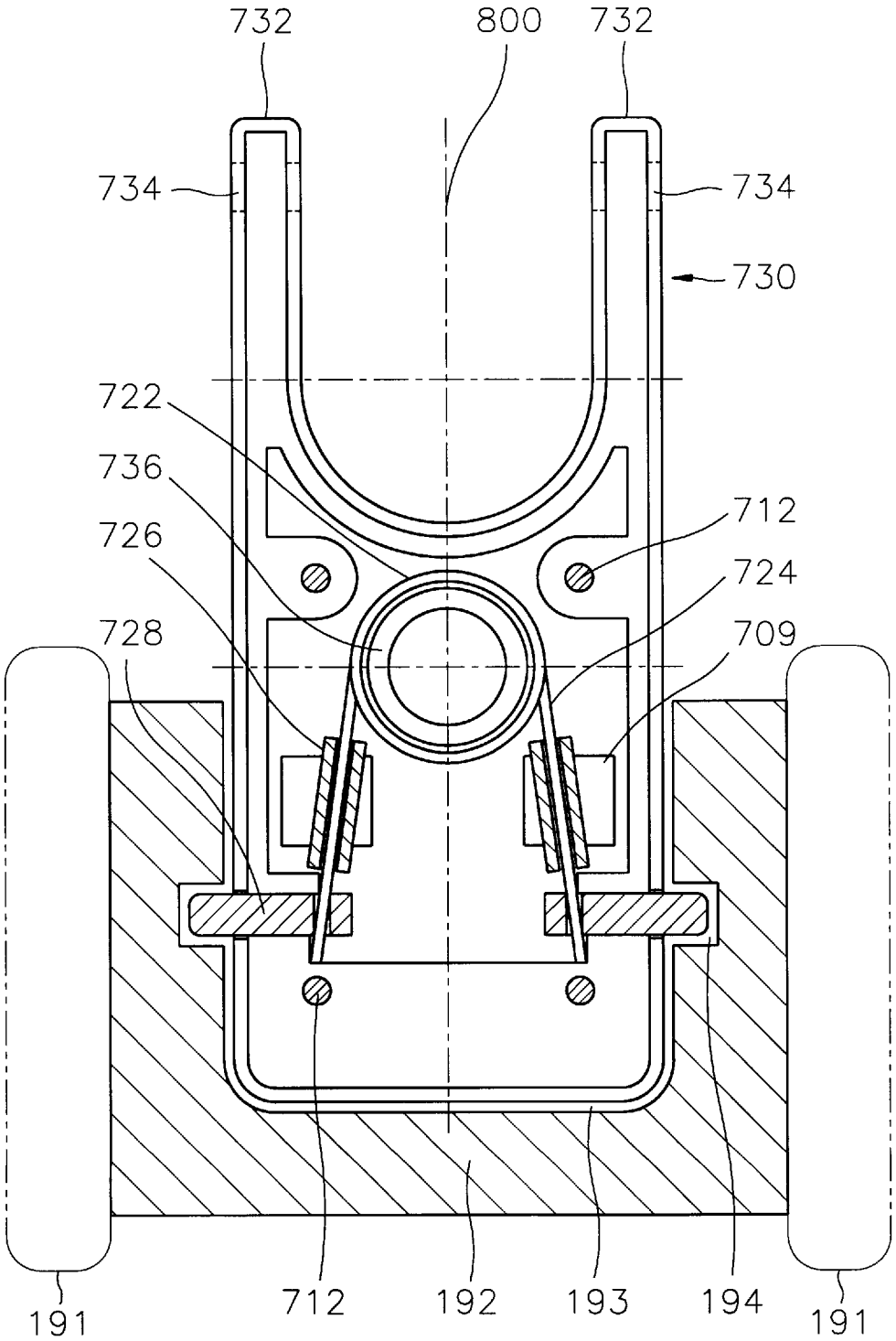
FIG. 7 is a sectional view showing the coupler assembly engaged with a cleaner body section.

Referring to FIG. 7, lever assembly 720 includes a torsion spring 721, a pair of sleeves 726 and a pair of sliders 728. Torsion spring 721 consists of an annular portion 722 and a pair of leg portions 724. In order to bias sliders 728 outward, each end of leg portions 724 is inserted into insert holes 729 formed on sliders 728 through sleeves 726. Therefore, when coupler assembly 700 is received in receptacle 193 formed at the front portion of drum 192, sliders 728 are protruded out of coupler assembly 700 by the biasing force of torsion spring 721 and are inserted into engagement holes 194 formed at the lower portion of receptacle 193.

On the other hand, annular portion 722 of torsion spring 721 has an inner diameter equal to an outer diameter of protuberance ring 736 so that lever assembly 720 may be securely engaged with protuberance ring 736. In addition, each slider 728 is slidably seated in elongated guide groove 744, and each sleeve 726 is disposed longitudinally across each third guide hole 709 in such a manner that sleeves 726 can slidably contact with slope portions 142 of protuberances 140.

Figure 9:
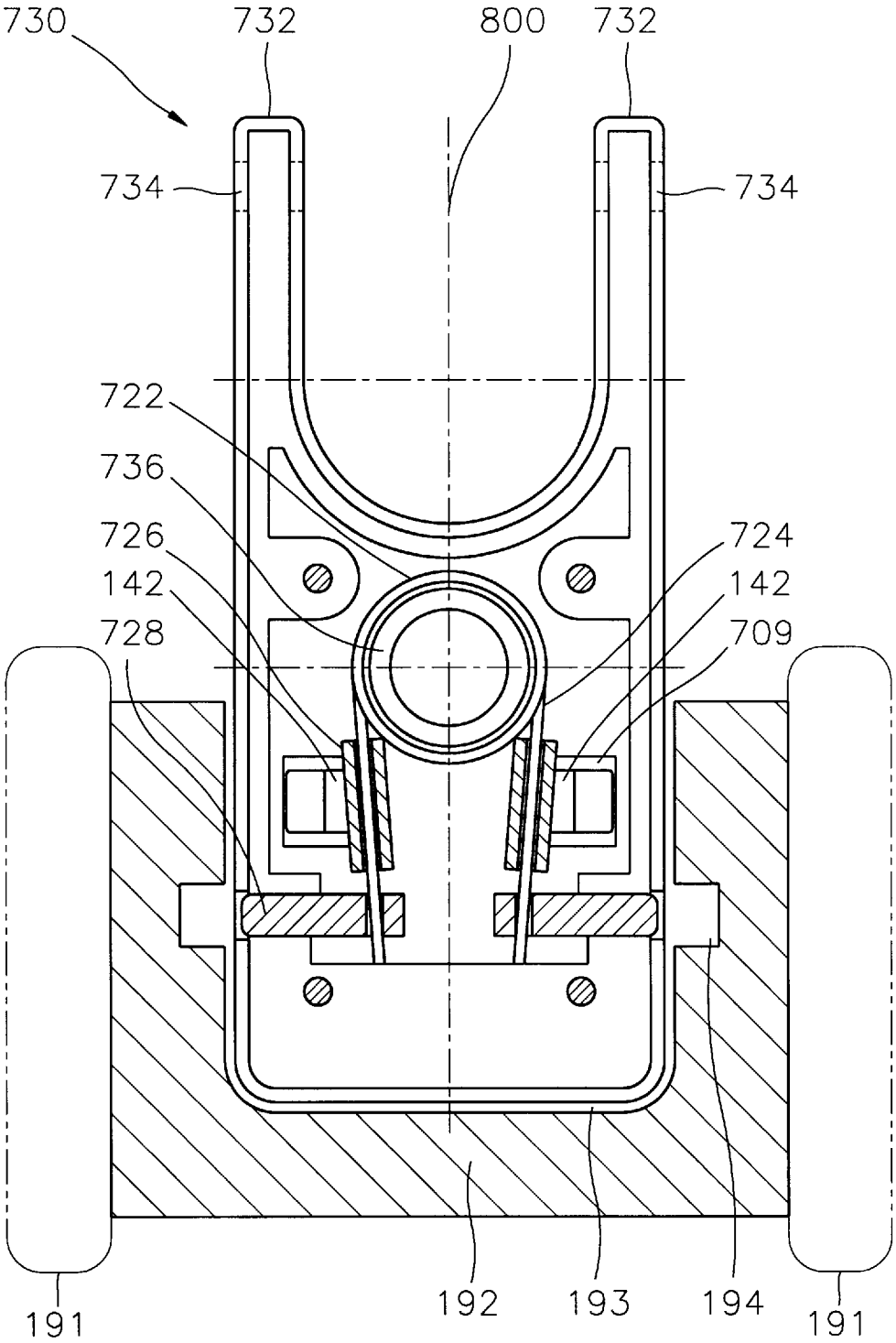
FIG. 9 is a sectional view showing the coupler assembly released from the cleaner body section.

Accordingly, when protuberances 140 enter between upper case 710 and frame 730 through third guide holes 709, the cylindrical outer walls of sleeves 726 make slide-contact with slope portions 142 of protuberances 140, so that sliders 728 may move into the interior of coupler assembly 700 along elongated guide groove 744 while overcoming the biasing force of torsion spring 721 as shown in FIG. 9.

Hereinafter, the operation of dual mode vacuum cleaner vacuum cleaner 100 according to the first embodiment of the present invention will be described.

When vacuum cleaner 100 is used in the upright mode, coupler assembly 700 is inserted in receptacle 193 of drum 192 as shown in FIG. 1. In this case, as shown in FIG. 7, sliders 728 are pushed outward and then inserted in engagement holes 194 by means of biasing force of torsion spring 721, so that dirt-collecting section 110 and cleaner-body section 190 are integrally coupled with each other (upright mode). In the upright mode, coupler assembly 700 can pivot about hinge pins 126, and the angle of vacuum cleaner 100 with respect to the ground is easily adjusted by handling handle 150.

Figure 2:
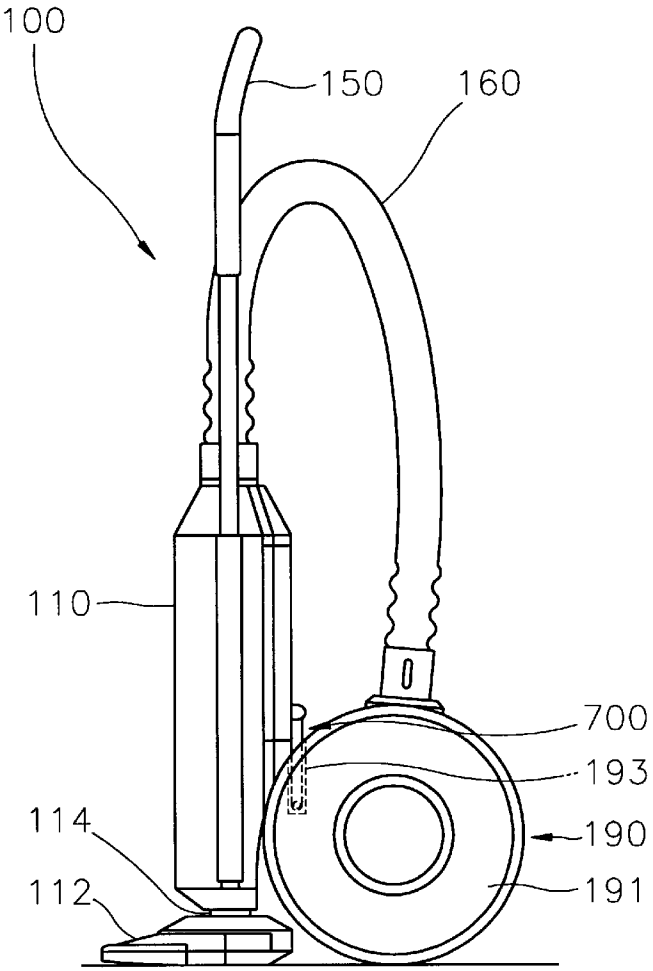
FIG. 2 is a side view of the dual mode vacuum cleaner according to the first embodiment of the present invention, in which a dirt-collecting section is upright at right angles to the ground.

When it is required to convert vacuum cleaner 100 from the upright mode to the canister mode, the user places vacuum cleaner 100 upright as shown in FIG. 2. In this case, coupler assembly 700 is closely adjacent to the rear wall of dirt-collecting section 110, and so that convex portions 772 which are formed integrally with first cylindrical heads 711 are engaged with concave portions 128 of leaf springs 127 which are secured to the inner wall of dirt-collecting section 110 as shown in FIG. 8.

At the same time, protuberances 140 which are formed at the rear wall of dirt-collecting section 110 enter the interior of coupler assembly 700 by way of second guide holes 707 and third guide holes 709. When protuberances 140 pass through third guide holes 709, as shown in FIG. 9, slope portions 142 of protuberances 140 may make slide-contact with sleeves 726 surrounding leg portions 724 of torsion spring 721, so that leg portions 724 may move toward a longitudinal axis 800 of coupler assembly 700. Therefore, sliders 728 which surround leg portions 724 also move toward longitudinal axis 800 along elongated guide groove 744, therefor, sliders 728 can be released from engagement holes 194.

Figure 4:
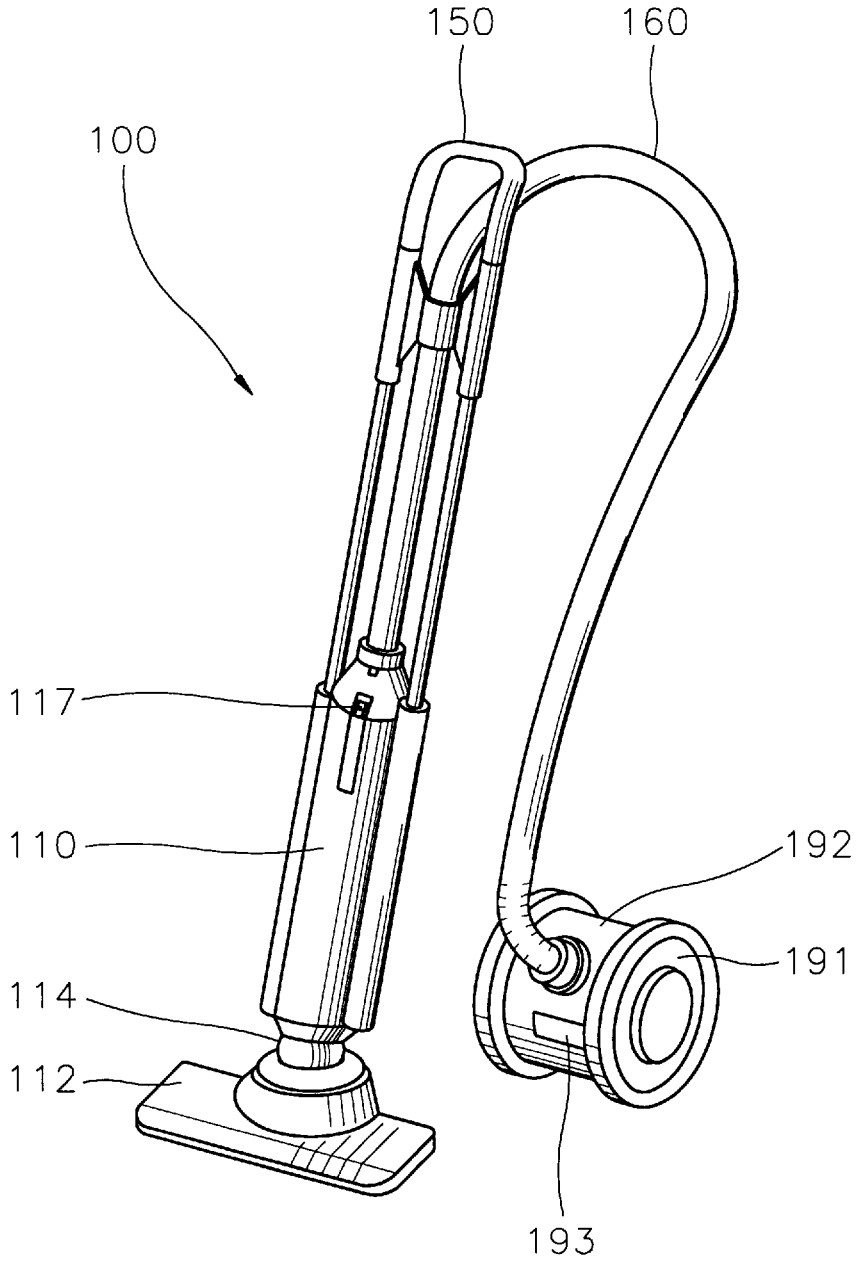
FIG. 4 is a side view of a dual mode vacuum cleaner in an upright mode according to the first embodiment of the present invention.

Accordingly, it is possible to separate coupler assembly 700 from receptacle 193, so that the user can use vacuum cleaner 100 in the canister mode as shown in FIG. 4.

As mentioned above, since convex portions 772 formed integrally with first cylindrical heads 711 are engaged with concave portions 128 of leaf springs 127 secured to the inner wall of dirt-collecting section 110, coupler assembly 700 can be securely maintained parallel to the rear wall of dirt-collecting section 110 while performing the cleaning.

When it is required to convert vacuum cleaner 100 from the canister mode to the upright mode again, the user places vacuum cleaner 100 upright again as shown in FIG. 2 and puts coupler assembly 700 into receptacle 193 of drum 192. Then, when the user moves coupler assembly 700 upwards as shown in FIG. 8 in phantom line, convex portions 772 are released from concave portions 128 of leaf springs 127, and at the same time, protuberances 140 are also released from coupler assembly 700. When protuberances 140 are released from coupler assembly 700, sliders 728 are forced again outward by the biasing force of torsion spring 721 so that sliders 728 are inserted in engagement holes 194 formed at the lower portion of receptacle 193 again as shown in FIG. 7. Therefore, dirt-collecting section 110 is again coupled to cleaner-body section 190 as shown in FIG. 1, so that the user can use vacuum cleaner 100 in the upright mode.

FIGS. 10 to 16 show a dual mode vacuum cleaner 100a and elements thereof according to the second embodiment of the present invention. Dual mode vacuum cleaner 100*a* is similar to vacuum cleaner 100 of the first embodiment except for several elements. Therefore, elements which are the same as compared with those of the first embodiment will not be further explained in the present embodiment.

Figure 10:
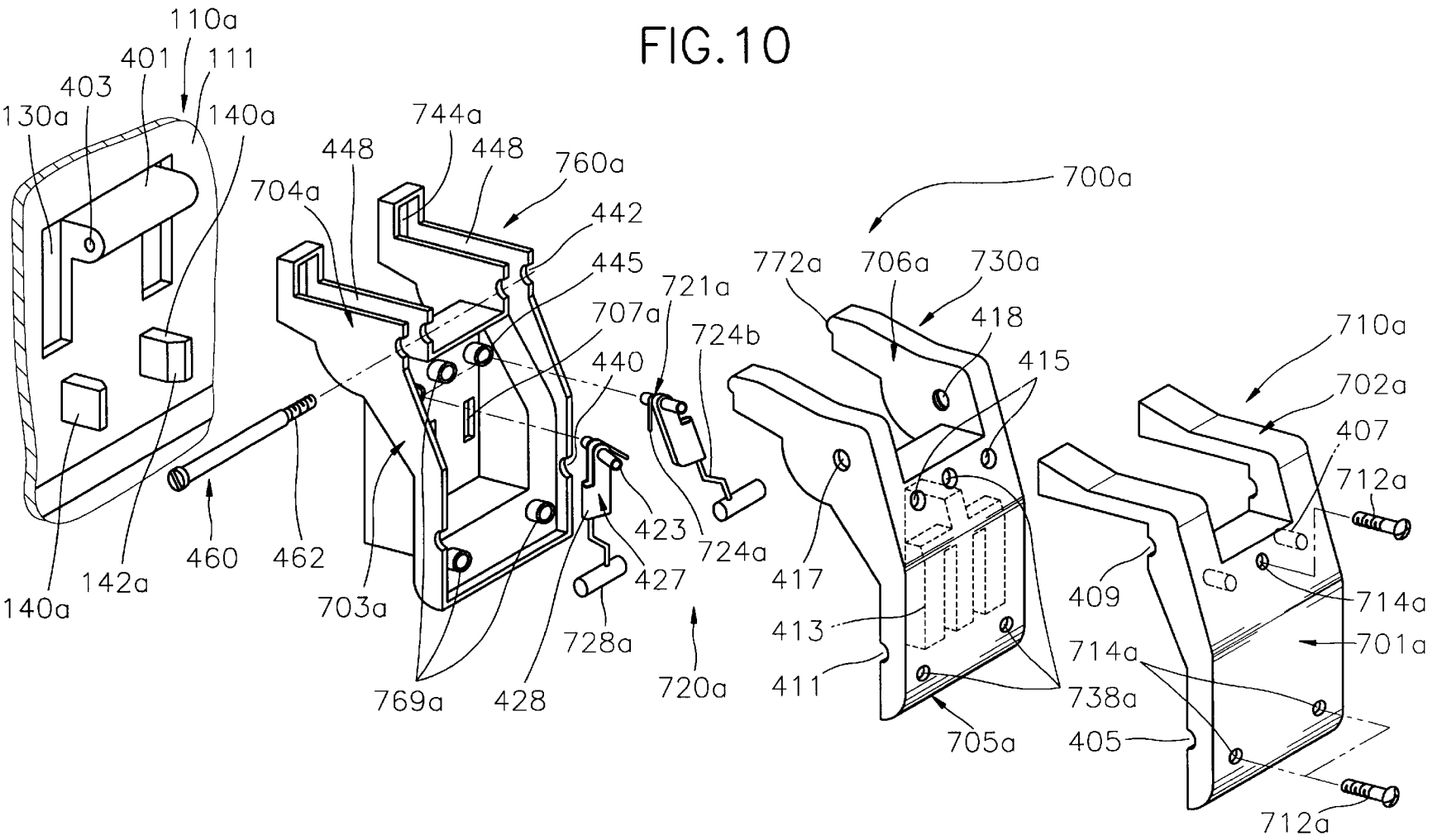
FIG. 10 is an exploded perspective view of a coupler assembly according to the second embodiment of the present invention.

Referring to FIG. 10, a pair of first guide holes 130*a* are formed at a rear wall 111 of a dirt-collecting section 110*a*. A hanger 401 for pivotally suspending a coupler assembly 700*a* to rear wall 111 of dirt-collecting section 110*a* is provided between first guide holes 130*a*. Hanger 401 is formed with a first perforation opening 403 into which a screw shaft 460 having a screw portion 462 at its terminal end is inserted. In addition, a pair of protuberances 140*a*, which are inserted into or released from coupler assembly 700*a* according to the conversion of the operation modes, are provided below the pair of first guide holes 130*a*. Each protuberance 140*a* has a slope portion 142*a* at the lead end thereof, and is formed integrally with rear wall 111 of dirt-collecting section 110*a*.

Coupler assembly 700*a* includes an upper case 710*a*, a lower case 760*a* which is assembled into upper case 710*a* by bolts 712*a*, a frame 730*a* disposed between upper case 710*a* and lower case 760*a*, and a pair of lever assemblies 720*a* disposed between lower case 760*a* and frame 730*a*. Upper case 710*a*, frame 730*a*, and lower case 760*a* have a similar shape.

Upper case 710*a* includes a first base portion 701*a* and a first fork portion 702*a* which is integrally formed at the upper portion of first base portion 701*a*. First base portion 701*a* is formed with a plurality of first perforation holes 714*a* into which bolts 712 pass through. In addition, at the upper inner wall of first base portion 701*a*, there are provided a pair of first pin holders 407 which are engaged with the pair of lever assemblies 720*a* in order to support the pair of lever assemblies 720*a*. A first semi-circular aperture 405 is formed at both lower side walls of upper case 710*a*, and a second semi-circular aperture 409 is formed at both upper side walls of upper case 710*a*, respectively.

Figure 12:
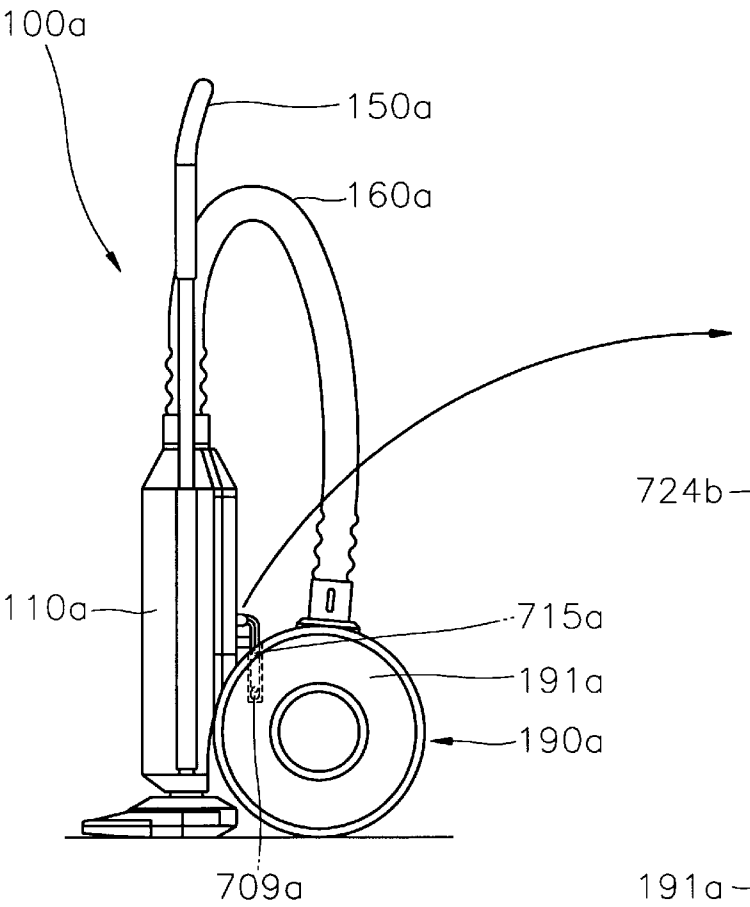
FIG. 12 is a side view of the dual mode vacuum cleaner according to the second embodiment of the present invention, in which a dirt-collecting section is upright at right angles to the ground.

Lower case 760*a* includes a second base portion 703*a* and a second fork portion 704*a* which is integrally formed at the upper portion of second base portion 703*a*. Second base portion 703*a* has a pair of second guide holes 707*a* which are disposed in correspondence to the pair of protuberances 140*a* in order to guide protuberances 140*a* into coupler assembly 700*a*. At the inner surface of second base portion 703*a*, there are provided a plurality of screw holes 769*a* which are disposed in correspondence to first perforation holes 714*a* in such a manner that bolts 712 passing through first perforation holes 714*a* can be screwed into screw holes 769*a*. A pair of second pin holders 445, which are engaged with lever assemblies 720*a* so as to support them, are formed at the inner upper wall of second base portion 703*a*. In addition, a third semi-circular aperture 440 is provided at both lower side walls of lower case 760*a*, and a fourth semi-circular aperture 442 is provided at both upper side walls of lower case 760*a*. As shown in FIG. 12, third semi-circular apertures 440 are incorporated with first semi-circular apertures 405 so as to form a pair of first circular holes 709*a*, and fourth semi-circular apertures 442 are incorporated with second semi-circular apertures 409 so as to form a pair of second circular holes 715*a*.

Second fork portion 704*a* is formed with a pair of guide passages 448, and a pair of cutting portions 744*a* are formed at the terminal end of guide passages 448.

Frame 730*a* includes a third base portion 705*a* and a third fork portion 706*a* which is integrally formed at the upper portion of third base portion 705*a*. Third base portion 705*a* has a plurality of second perforation holes 738*a*, which are disposed in correspondence to first perforation holes 714*a* in such a manner that bolts 712*a* can pass therethrough, and a pair of third perforation holes 415, which are disposed in correspondence to the pair of first pin holders 407 in such a manner that first pin holders 407 can pass therethrough. In addition, third base portion 705*a* has a support member 413 for supporting lever assemblies 720*a*. Each lever assembly 720*a* constantly touches each side wall of support member 413, respectively.

A semi-circular elongated guide groove 411 which communicates with first semicircular apertures 405 is formed at the lower portion of frame 730*a*. In addition, at the upper portion of frame 730*a*, there are formed a second perforation opening 417 which communicates with first perforation opening 403 formed in hanger 401, and a third perforation opening 418 which is formed at its inner wall with an internal screw so as to receive screw portion 462 of screw shaft 460.

Figure 13:
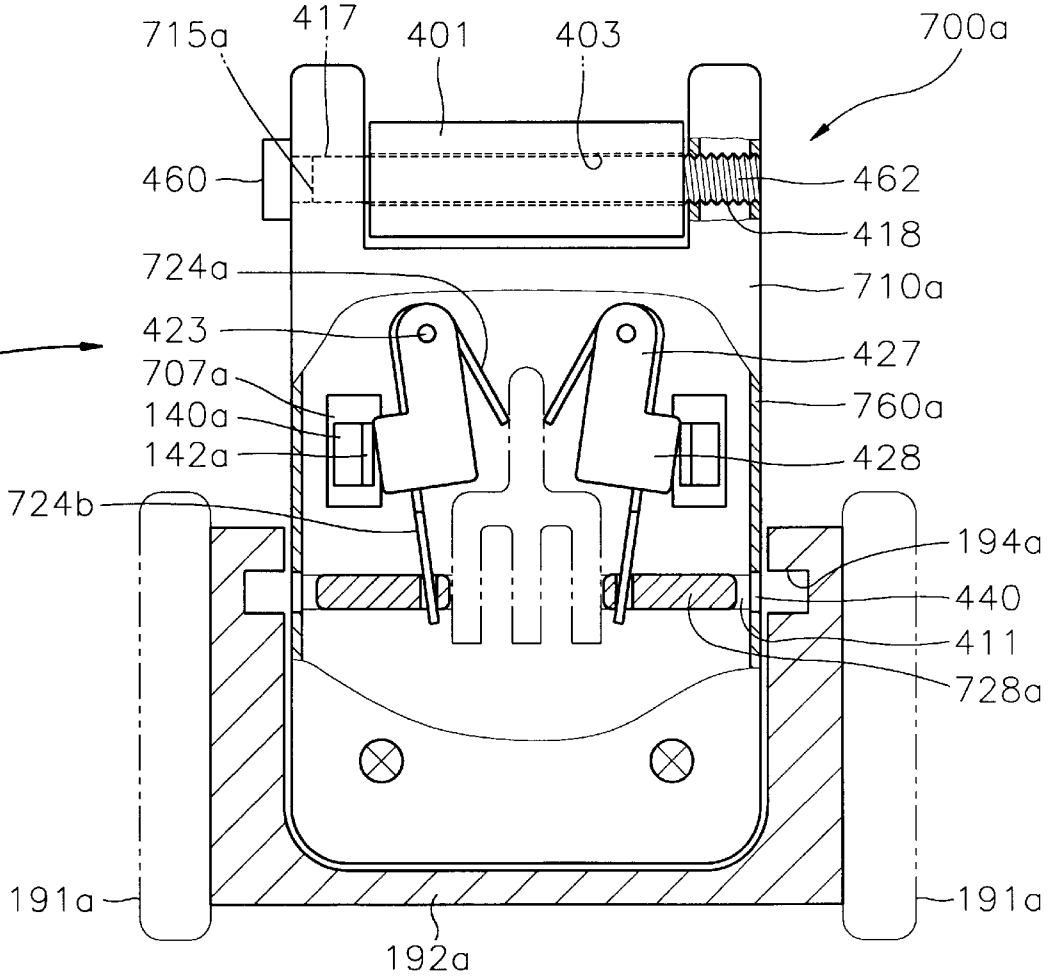
FIG. 13 is a partial-sectional view showing the coupler assembly released from a cleaner body section.

As shown in FIG. 13, screw shaft 460 is screw-coupled into third perforation opening 418 by way of second circular hole 715*a*, second perforation opening 417, and first perforation opening 403 of hanger 401 so that coupler assembly 700*a* is pivotally coupled to dirt-collecting section 110*a*.

Figure 16:
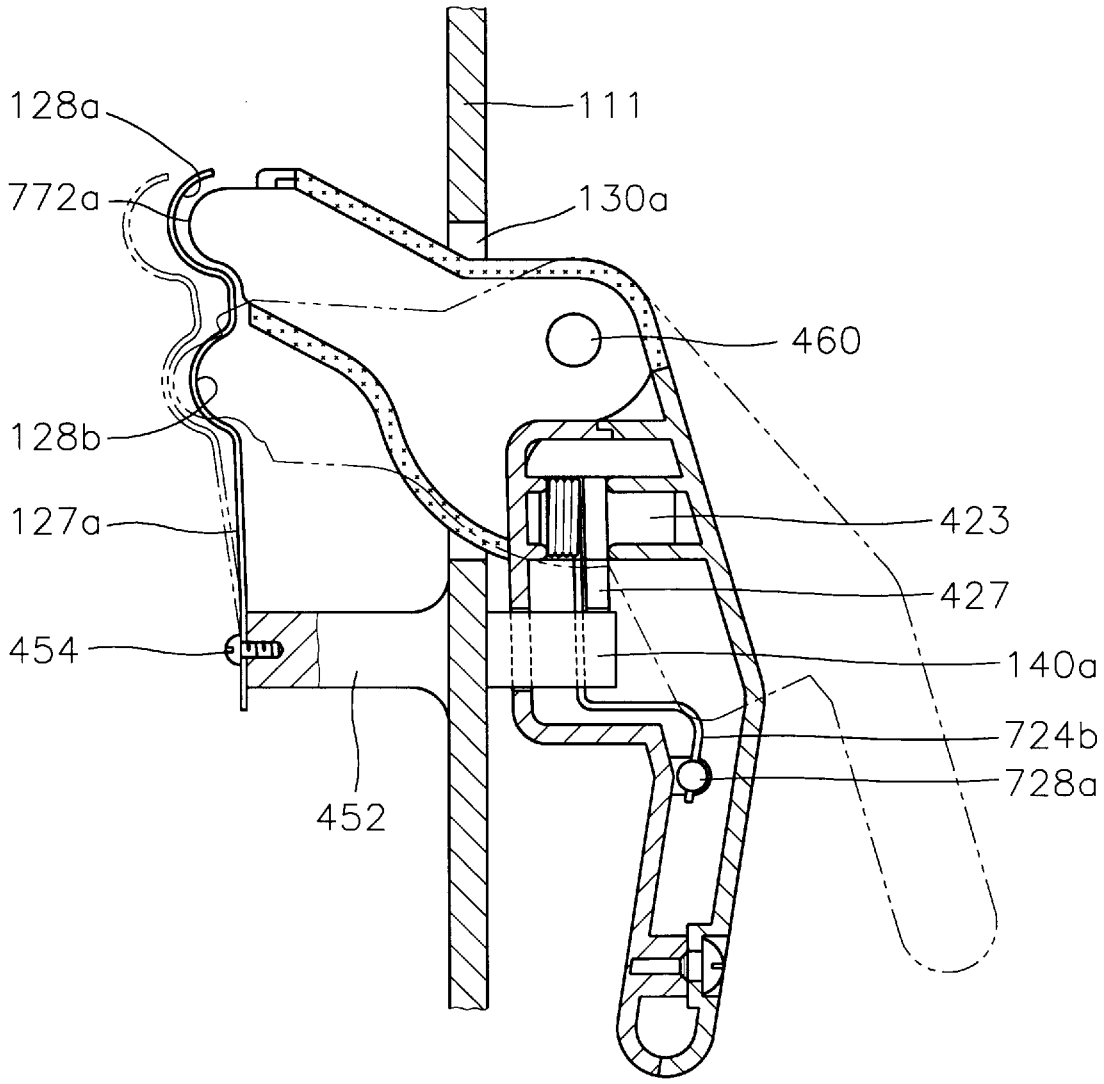
FIG. 16 is a side view of the coupler assembler mounted on the dirt-collecting section according to the second embodiment of the present invention.
Figure 17:
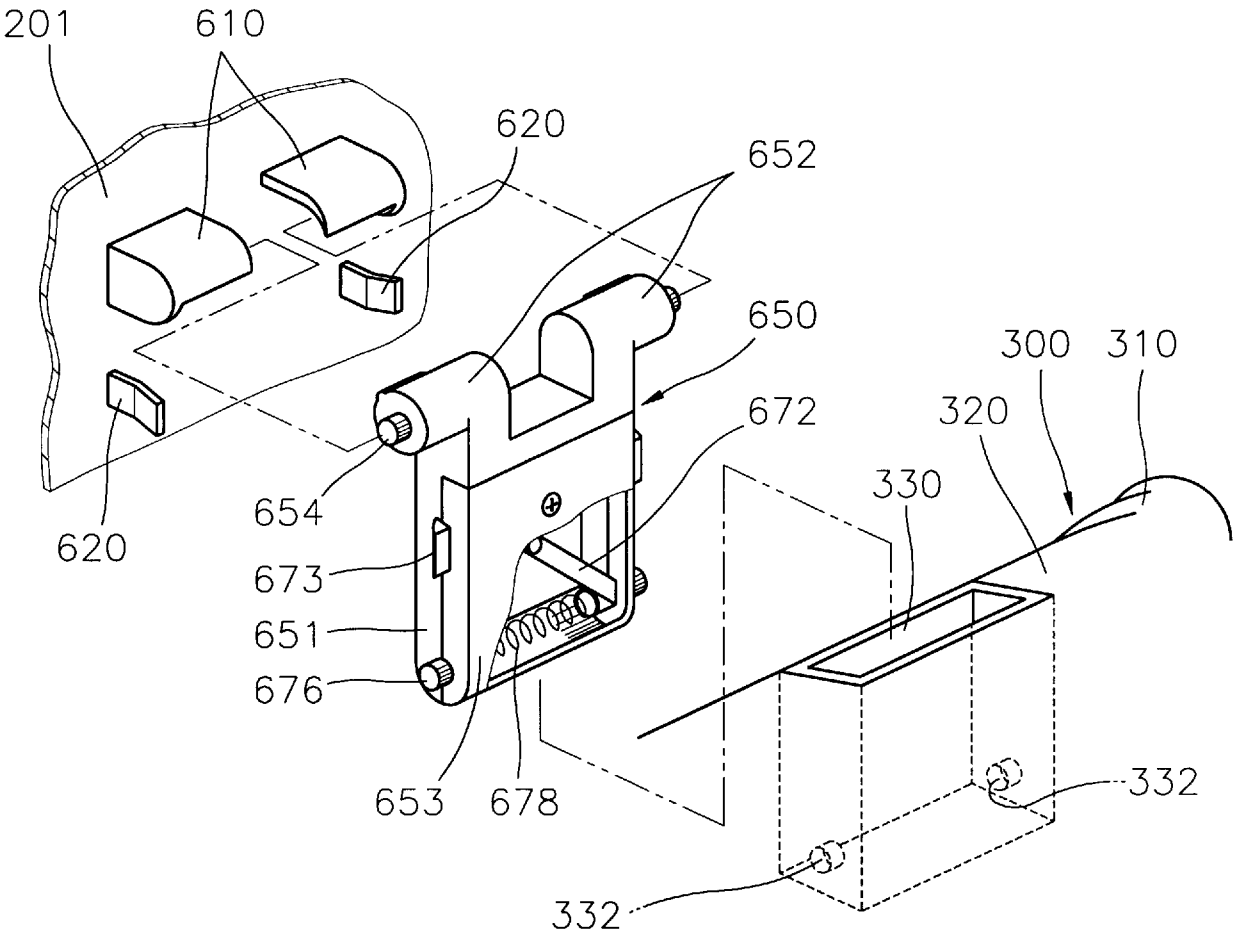
FIG. 17 (PRIOR ART)
FIG. 17 is an exploded perspective view of a conventional coupler, a dirt-collecting section and a cleaner body section.
Figure 19:
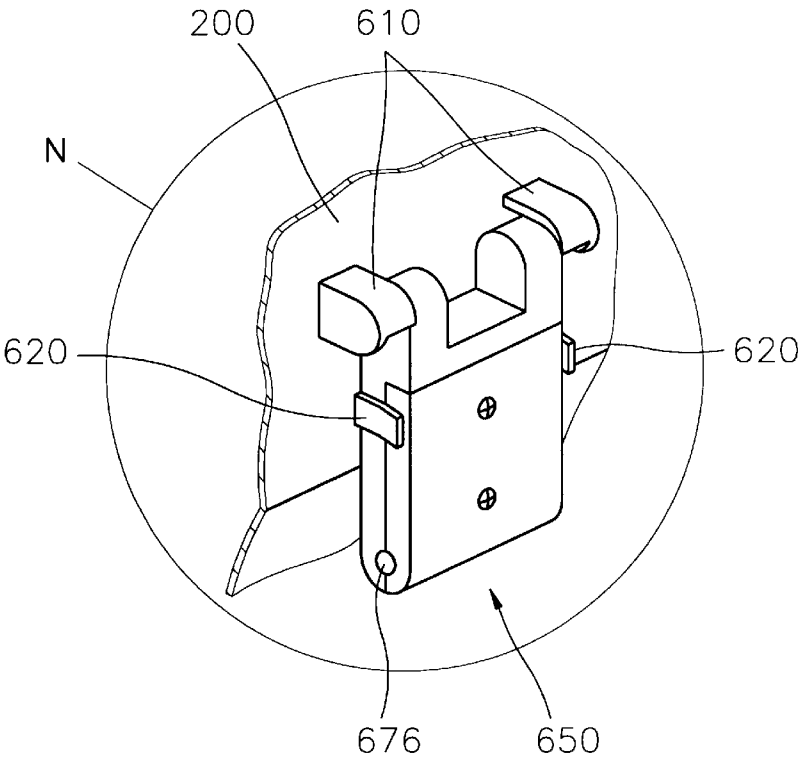
FIG. 19 (PRIOR ART)
FIG. 19 is an enlarged view of the "N" portion shown in FIG. 18.
Figure 18:
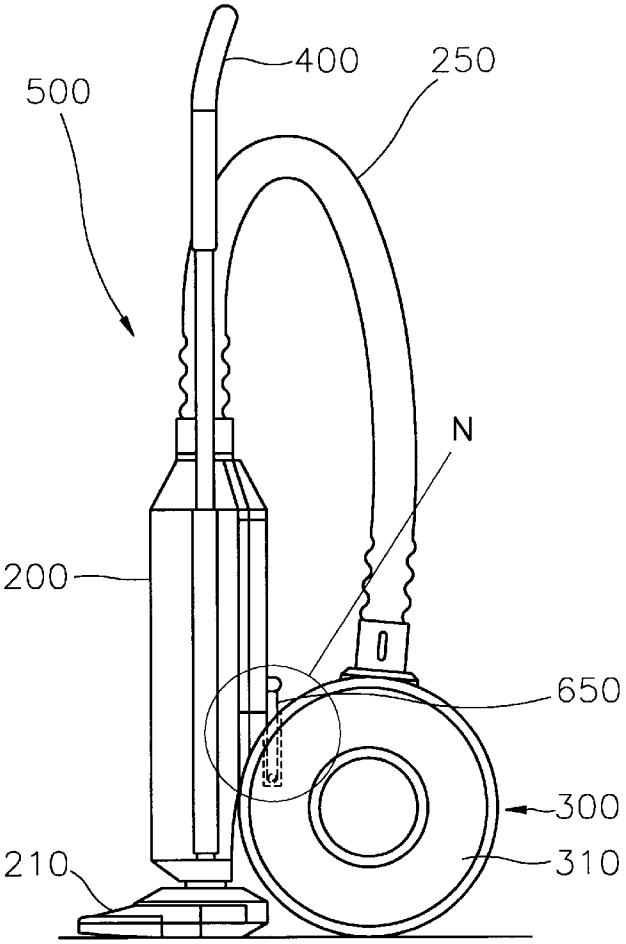
FIG. 18 (PRIOR ART)
FIG. 18 is a side view of a conventional vacuum cleaner.
Figure 21:
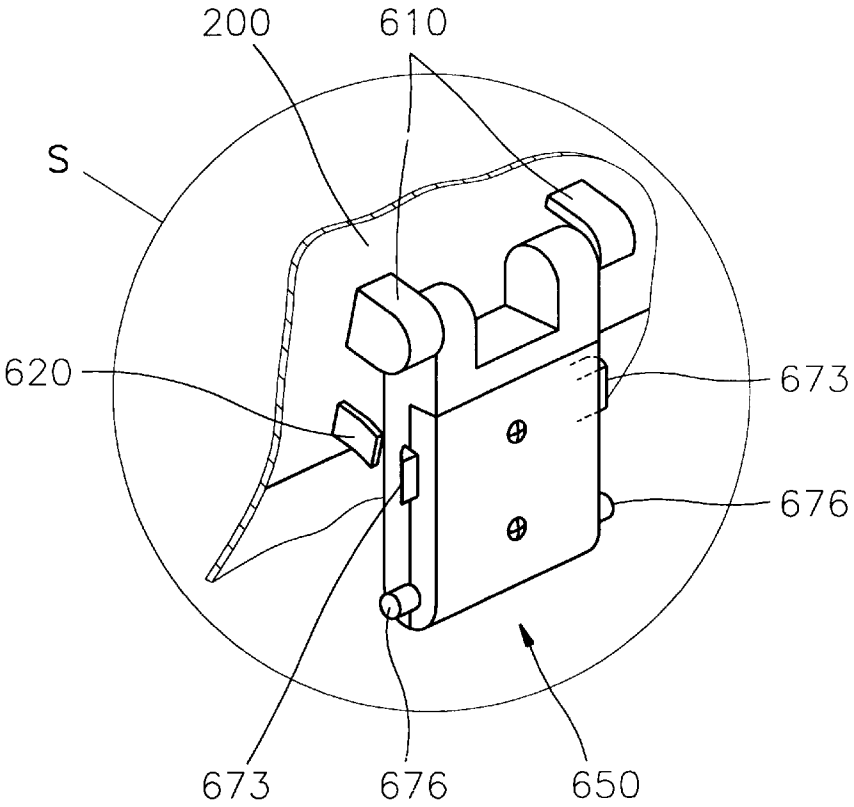
FIG.21 (PRIOR ART)
FIG. 21 is an enlarged view of "S" portion shown in FIG. 20.
Figure 20:
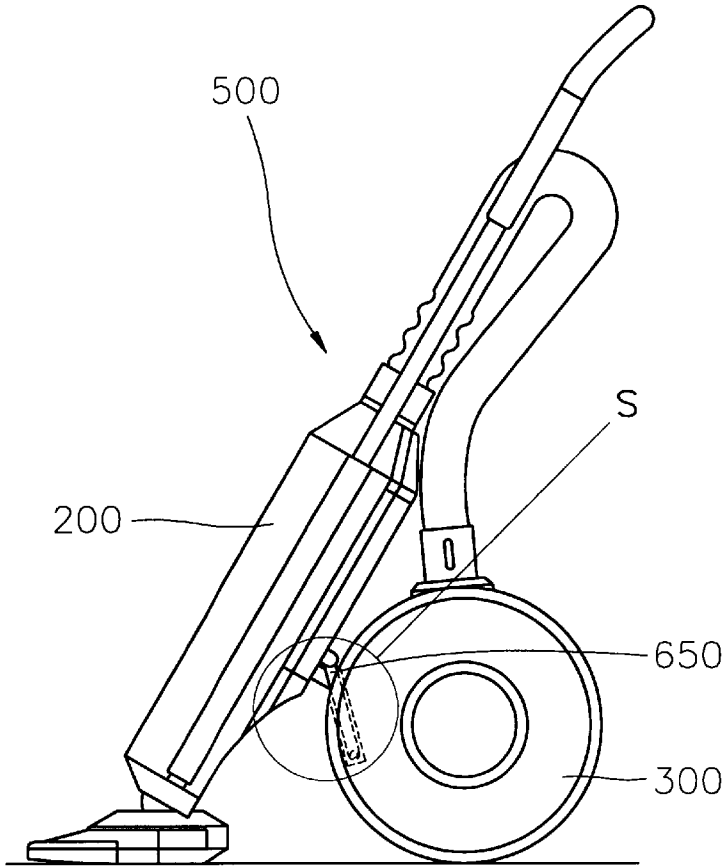
FIG.20 (PRIOR ART)
FIG. 20 is a side view of conventional vacuum cleaner in a upright mode.

Third fork portion 706*a* is engaged with guide passages 448 of second fork portion 704*a*, and is formed at its terminal end with a pair of convex portions 772*a* which extend into the interior of dirt-collecting section 110*a* by way of cutting portions 744*a* of second fork portion 704*a* and first guide hole 130*a*. In addition, as shown in FIG. 16, a support plate 452 is provided at the inner surface of rear wall 111 of dirt-collecting section 110*a*. A pair of leaf springs 127*a*, which are formed with a first concave portion 128*a* and a second concave portion 128*b* respectively, are secured to support plate 452 by a bolt 454. Convex portion 772*a* is alternately engaged with first concave portion 128*a* and second concave portion 128*b* of leaf spring 127*a* when the operation mode is converted, so that coupler assembly 700*a* may be fixed at the predetermined position while performing cleaning.

First fork portion 702*a*, second fork portion 704*a*, and third fork portion 706*a* are declined at a predetermined angle with respect to first base portion 701*a*, second base portion 703*a*, and third fork portion 706*a* respectively, so that coupler assembly 700*a* may easily pivot about screw shaft 460.

Referring again to FIG. 10, each lever assembly 720*a* includes an arm portion 427 having a slide-contact portion 428 for contacting slope portion 142*a* of protuberance 140*a* at its lower portion. Each lever assembly 720*a* also includes a hinge pin 423 which passes through the upper portion of arm portion 427, a torsion spring 721*a* which is closely wound around hinge pin 423, and a slider 728*a* connected to torsion spring 721*a* in such a manner that it can move inwards or outward along first semi-circular groove 411 of coupler assembly 700*a*.

As shown in FIG. 13, each torsion spring 721*a* includes a first leg portion 724*a* and a second leg portion 724*b*. First leg portion 724*a* constantly touches a side wall of support member 413. Second leg portion 724*b* is longer than first leg portion 724*a*, and is inserted into an insert hole 729*a* formed on slider 728*a* through arm portion 427 in such a manner that second leg portion 724*b* can bias slider 728*a* outward.

Figure 11:
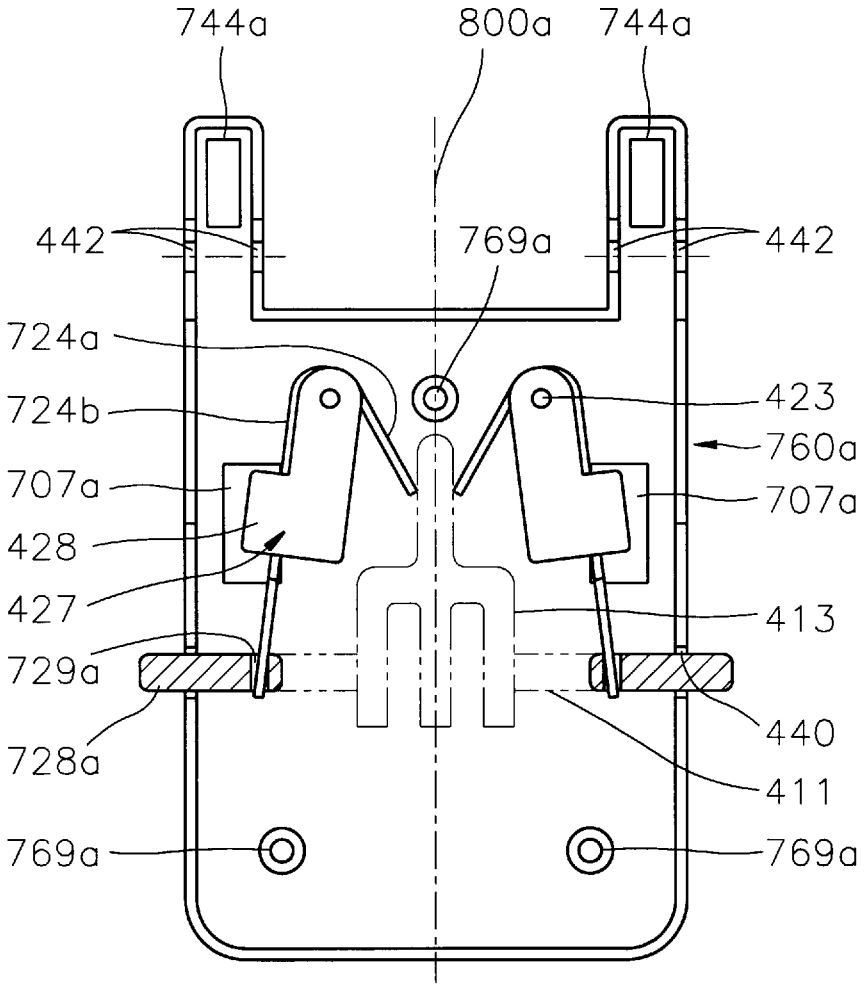
FIG. 11 is a schematic view showing a lever assembly assembled into a lower case.

Therefore, as shown in FIG. 11, when coupler assembly 700*a* is received in receptacle 193*a* formed at the front portion of drum 192*a*, sliders 728*a* are protruded out of coupler assembly 700*a* by the biasing force of torsion spring 721*a*, and are inserted into engagement holes 194*a* formed at the lower portion of receptacle 193*a*.

On the other hand, first and second ends of hinge pin 423 are pivotally inserted into first pin holder 407 and second pin holder 445, respectively. In addition, slider 728*a* is slidably seated in semi-circular elongated guide groove 411 formed in frame 730*a*, and slide-contact portion 428 of arm portion 427 is disposed longitudinally across each second guide hole 707*a* in such a manner that slide-contact portion 428 can make slide-contact with slope portion 142*a* of protuberance 140*a*.

Accordingly, when protuberances 140*a* enter between lower case 760*a* and frame 730*a* through second guide holes 707*a*, slide-contact portions 428 and slope portions 142*a* of protuberances 140*a* make slide-contact with each other, so that slider 728*a* may move into the interior of coupler assembly 700*a* along semi-circular elongated guide groove 411 while overcoming the biasing force of torsion spring 721*a* as shown in FIG. 13.

Vacuum cleaner 100*a* according to the second embodiment of the present invention operates as follows.

Figures 14, 15:
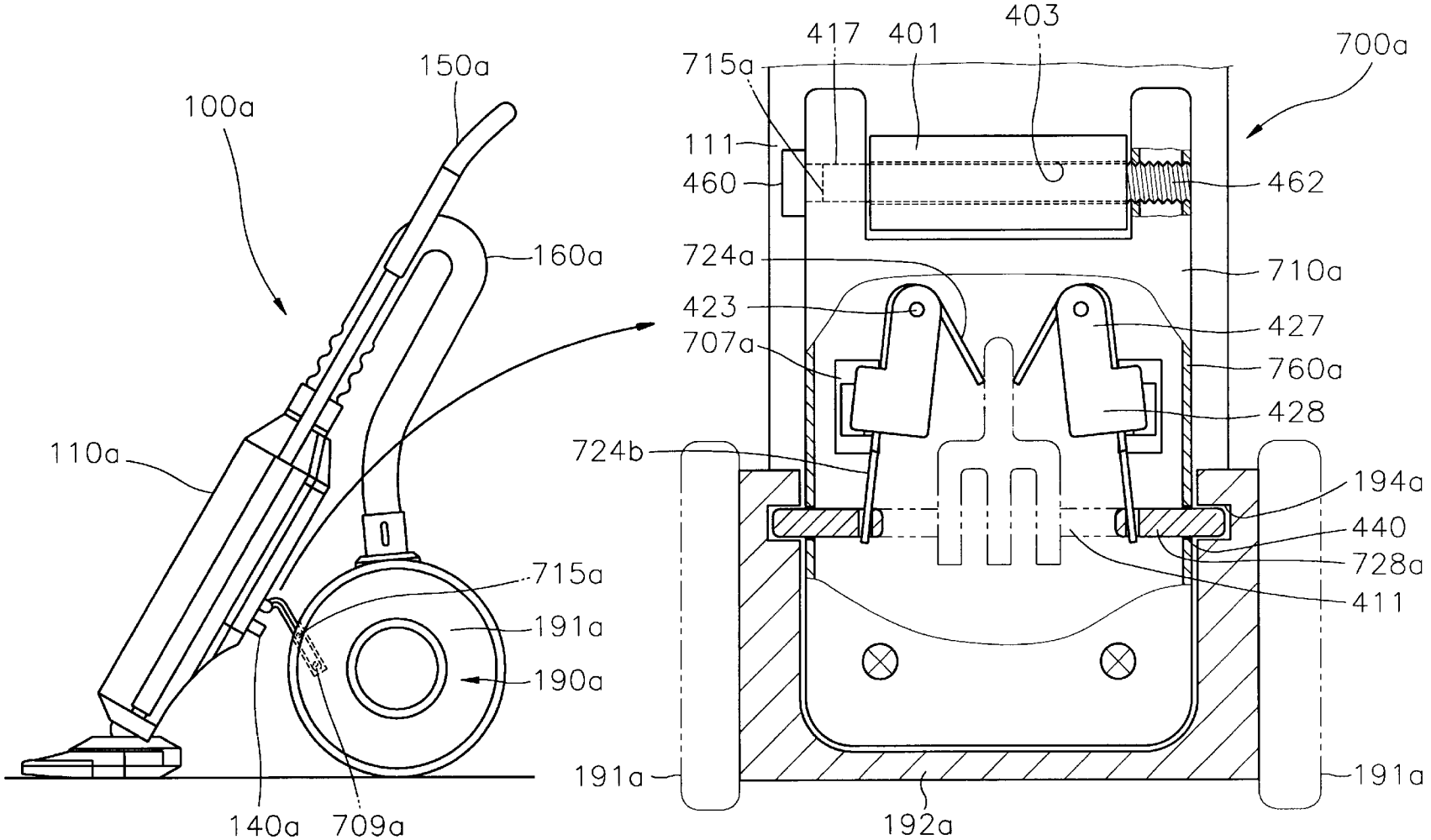
FIG. 14 is a side view of a dual mode vacuum cleaner in an upright mode according to the second embodiment of the present invention.
FIG. 15 is a sectional view showing the coupler assembly engaged with a cleaner body section according to the second embodiment of the present invention.

When vacuum cleaner 100*a* is used in the upright mode, coupler assembly 700*a* is inserted in receptacle 193*a* of drum 192*a* as shown in FIG. 14. In this case, as shown in FIG. 15, sliders 728*a* are pushed outward and then inserted into engagement holes 194*a* of receptacle 193*a* by means of biasing force of torsion spring 721*a*, so that dirt-collecting section 110*a* and cleaner-body section 190*a* are integrally coupled with each other (upright mode).

When it is required to convert vacuum cleaner 100*a* from the upright mode to the canister mode, the user places vacuum cleaner 100*a* upright as shown in FIG. 12. In this case, coupler assembly 700*a* is closely adjacent to rear wall 111 of dirt-collecting section 110*a*, and so that convex portions 772*a* which are formed at the terminal end of third fork portion 706*a* are engaged with first concave portions 128*a* of leaf springs 127*a* which are secured to the inner wall of dirt-collecting section 110*a* as shown in FIG. 16.

At the same time, protuberances 140*a* which are formed at rear wall 111 of dirt-collecting section 110 enter the interior of coupler assembly 700*a* through second guide holes 707*a*. When protuberances 140*a* pass through second guide holes 707*a*, as shown in FIG. 13, slope portions 142*a* of protuberances 140*a* make slide-contact with slide-contact portion 428 of lever assembly 720*a* so that second leg portions 724*b* of torsion spring 721*a* may move toward a longitudinal axis 800*a* of coupler assembly 700*a*. Therefore, sliders 728*a* which are engaged with second leg portion 724*b* also move toward longitudinal axis 800*a* along semi-circular elongated guide groove 411, so sliders 728 can be released from engagement holes 194*a*.

Accordingly, it is possible to separate coupler assembly 700*a* from receptacle 193*a*, so that the user can use vacuum cleaner 100*a* in the canister mode.

As mentioned above, since convex portions 772*a* are engaged with first concave portions 128*a* of leaf springs 127*a* secured to the inner wall of dirt-collecting section 110*a*, coupler assembly 700*a* can be securely maintained parallel to rear wall 111 of dirt-collecting section 110*a* while performing the cleaning.

When it is required to convert vacuum cleaner 100*a* from the canister mode to the upright mode again, the user places vacuum cleaner 100*a* upright again as shown in FIG. 12 and puts coupler assembly 700*a* into receptacle 193*a* of drum 192*a*. Then, when the user moves coupler assembly 700*a* upward as shown in FIG. 16 in phantom line, convex portions 772*a* are released from first concave portions 128*a* of leaf springs 127*a*, and are engaged with second concave portions 128*b*. At the same time, protuberances 140*a* are also released from coupler assembly 700*a*. As protuberances 140*a* are released from coupler assembly 700*a*, sliders 728*a* are forced again outward by the biasing force of torsion spring 721*a* so that sliders 728*a* are inserted in engagement holes 194*a* formed at the lower portion of receptacle 193*a* again as shown in FIG. 15. Therefore, dirt-collecting section 110*a* is again coupled to cleaner-body section 190*a*, so that the user can use vacuum cleaner 100*a* in the upright mode.

At this time, since convex portions 772*a* maintain coupled to first concave portions 128*a*, coupler assembly 700*a* also maintains tilted to dirt-collecting section 110*a* while performing the cleaning.

When coupler assembly 700*a* is maintained tilted to dirt-collecting section 110*a* as mentioned above, the user can easily move vacuum cleaner 100*a* forward and backward while cleaning.

As described above, the dual mode vacuum cleaner according to the present invention is easily and rapidly converted from the canister mode to the upright mode by simple handling.

Further, since the conversion of the operating modes is achieved in the interior of the coupler assembly by the interaction of elements, elements do not protrude out of the coupler assembly thereby giving the vacuum cleaner an improved external appearance.

Furthermore, since the coupler assembly has a firm internal structure, the life span of the coupler assembly is lengthened and its durability is improved.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A vacuum cleaner comprising:

a cleaner body section including a drum and a pair of wheels provided at both side walls of the drum;

a dirt-collecting section for sucking and collecting a dirt, the dirt-collecting section having a brush head at a first lower portion thereof and being connected to the cleaner body section by a flexible hose;

a first means for coupling the cleaner body section to the dirt-collecting section;

a second means for separating the cleaner body section from the dirt-collecting section, the second means being incorporated with the first means; and a third means for securely setting the first means, so that the cleaner body section can be easily coupled to or separated from the dirt-collecting section, wherein the first means includes a receptacle formed at a front portion of the drum, a coupler assembly received in the receptacle, and a fourth means for pivotally securing the coupler assembly to the dirt-collecting section, the receptacle being provided at first lower side walls thereof with an engagement hole respectively.

2. A vacuum cleaner as claimed in claim 1, wherein the coupler assembly includes an upper case which is integrally formed at a first upper portion thereof with a first fork portion, a lower case which is assembled into the upper case by bolts and is integrally formed at a second upper portion thereof with a second fork portion, a frame which is disposed between the upper case and the lower case and is integrally formed at a third upper portion thereof with a third fork portion, and a lever assembly disposed between the upper case and the frame, the first fork portion being provided with a pair of first semi-cylindrical head portions at a first terminal end thereof, the second fork portion being provided with a pair of second semi-cylindrical head portions at a second terminal end thereof, the pair of second semi-cylindrical head portions being incorporated with the first semi-cylindrical head portions so as to form a pair of first cylindrical head portions, the third fork portion being provided with a pair of second cylindrical head portions at a third terminal end thereof, the pair of second cylindrical head portions being accommodated in the first cylindrical head portions.

3. A vacuum cleaner as claimed in claim 2, where the first, second and third fork portions are declined at an predetermined angle with respect to the upper case, the lower case and the frame, respectively.

4. A vacuum cleaner as claimed in claim 2, wherein the upper case is formed at second lower side walls thereof with a first cutting portion respectively, the lower case is formed at third lower side walls thereof with a second cutting portion respectively, the second cutting portion being incorporated with the first cutting portion so as to form a rectangular hole, the frame is formed at a second lower portion thereof with an elongated guide groove, the elongated guide groove being disposed in correspondence to the rectangular hole, the lever assembly includes a torsion spring having an annular portion and a pair of leg portions, a pair of sleeves securely engaged with the leg portions, and a pair of sliders, each slider having insert hole thereon into which end parts of the leg portions are inserted, each slider being slidably seated in the elongated guide groove, the torsion spring biasing sliders to an exterior of the coupler assembly so that sliders are inserted into engagement holes of the receptacle through the rectangular hole as the coupler assembly is received in the receptacle.

5. A vacuum cleaner as claimed in claim 4, wherein the frame has a protuberance ring for suspending the lever assembly, the protuberance ring being engaged with the annular portion of the torsion spring.

6. A vacuum cleaner as claimed in claim 4, wherein the fourth means includes a pair of first guide holes formed at a rear wall of the dirt-collecting section so as to receive the pair of first cylindrical heads, a pair of first pin holes formed in the first cylindrical heads, a pair of second pin holes formed in the second cylindrical heads, two pairs of suspension plates, and two pairs of hinge pins, each pair of suspension plates being disposed at a fourth upper portion of each first guide hole and extended toward an interior of the dirt-collecting section in such a manner that suspension plates are faced with each other, each hinge pin being provided at each suspension plate and inserted in the second pin hole through the first pin hole.

7. A vacuum cleaner as claimed in claim 6, wherein the third means includes a pair of convex portions which are integrally formed at first cylindrical heads respectively, a pair of leaf springs which are secured to the dirt-collecting section by a bolt and extended downward along the pair of first guide holes, and a pair of canopies formed integrally with the rear wall of the dirt-collecting section in such a manner that canopies surround the first semi-cylindrical heads.

8. A vacuum cleaner as claimed in claim 7, wherein each leaf spring has a concave portion, and each convex portion is detachably engaged with the concave portion.

9. A vacuum cleaner as claimed in claim 6, wherein the second means includes a pair of protuberances having a slope portion at a front portion thereof respectively, a pair of second guide holes formed in the lower case, and a pair of third guide holes formed in the frame, the pair of protuberances being integrally formed with the rear wall of the dirt-collecting section, the second and third guide holes being disposed in correspondence to the pair of protuberances so as to guide the protuberances into the coupler assembly.

10. A vacuum cleaner as claimed in claim 9, wherein each sleeve is disposed longitudinally across each third guide hole in such a manner that sleeves can slide-contact with slope portions of protuberances.

11. A vacuum cleaner as claimed in claim 1, wherein the coupler assembly includes an upper case which is integrally formed at a first upper portion thereof with a first fork portion, a lower case which is assembled into the upper case by bolts and integrally formed at a second upper portion thereof with a second fork portion, a frame which is disposed between the upper case and the lower case and is integrally formed at a third upper portion thereof with a third fork portion, and a pair of lever assemblies disposed between the lower case and the frame, the upper case being provided at second lower side walls thereof with a first semi-circular aperture respectively, the upper case being provided at first upper side walls thereof with a second semi-circular aperture respectively, the lower case being provided at third lower side walls thereof with a third semi-circular aperture respectively, the lower case being provided at second upper side walls thereof with a fourth semi-circular aperture respectively, the frame being formed at a second lower portion thereof with a semi-circular elongated guide groove communicated with the first semi-circular aperture, the first semi-circular aperture being incorporated with the third semi-circular aperture so as to form a first circular hole, the second semi-circular aperture being incorporated with the fourth semi-circular aperture so as to form a second circular hole.

12. A vacuum cleaner as claimed in claim 11, wherein the first, second and third fork portions are declined at an predetermined angle with respect to the upper case, the lower case and the frame, respectively.

13. A vacuum cleaner as claimed in claim 11, wherein the second fork portion is formed with a pair of guide passages, and the third fork portion is engaged with the guide passages.

14. A vacuum cleaner as claimed in claim 11, wherein the upper case is provided at a first upper inner wall thereof with a pair of first pin holders, the lower case is provided at a second upper inner wall thereof with a pair of second pin holders which are disposed in correspondence to the pair of first pin holders, the frame is provided at a first inner wall thereof with a support member for supporting lever assemblies, each lever assembly includes an arm portion, a hinge pin which passes through a fourth upper portion of the arm portion, a torsion spring closely wound around the hinge pin and a slider, the torsion spring including a first leg portion and a second leg portion which is longer than the first leg portion, the slider being securely engaged with a terminal end of the second leg portion of the torsion spring, the hinge pin having a first and second ends inserted into the first and second pin holders respectively, the slider being slidably seated in the semi-circular elongated guide groove, the torsion spring biasing the slider to an exterior of the coupler assembly so that slider is inserted into engagement hole of the receptacle through the first circular hole as the coupler assembly is received in the receptacle.

15. A vacuum cleaner as claimed in claim 14, wherein the fourth means includes a pair of first guide holes formed at a rear wall of the dirt-collecting section so as to receive the second fork portion, a hanger disposed between first guide holes and formed with a first perforation opening penetrating therethrough, a second and third perforation openings which are formed at the third upper portion of the frame in opposition to each other and communicated with first circular holes respectively, and a screw shaft formed at one end thereof with a screw portion, the third perforation opening being formed at a second inner wall thereof with an internal screw so as to receive the screw portion of the screw shaft, the screw shaft being screw-coupled into the third perforation opening by way of the second circular hole, the second perforation opening, and the first perforation opening of the hanger, so that the coupler assembly is pivotally coupled to the rear wall of the dirt collecting section.

16. A vacuum cleaner as claimed in claim 15, wherein the second means includes a pair of protuberances having a slope portion at a front portion thereof respectively, a pair of second guide holes formed in the lower case, and a slide-contact portion formed integrally with a third lower portion of the arm portion, the pair of protuberances being integrally formed with the rear wall of the dirt-collecting section, the second guide holes being disposed in correspondence to the pair of protuberances so as to guide the protuberances into the coupler assembly, the slide-contact portion being disposed longitudinally across each second guide hole in such a manner that the slide-contact portion can slide-contact with slope portions of protuberances.

17. A vacuum cleaner as claimed in claim 11, wherein the third means includes a pair of cutting portions formed at a terminal end of the second fork portion, a pair of convex portions which are integrally formed at a terminal end of the third fork portion and extended into an interior of the dirt-collecting section through cutting portions, a support plate formed integrally with an inner surface of the rear wall of the dirt-collecting section, and a pair of leaf springs which are secured to the support plate by a bolt and extended downward along the first guide holes, each leaf spring having a first and a second concave portions, the first concave portion being longitudinally spaced apart from the second concave portion, the convex portion being alternatively engaged with the first and second concave portions.

18. A vacuum cleaner comprising:

a cleaner body section including a drum and a pair of wheels provided at both side walls of the drum, the drum having a receptacle at a front portion thereof, the receptacle being provided at first lower side walls thereof with an engagement hole respectively;

a dirt-collecting section for sucking and collecting a dirt, the dirt-collecting section having a brush head at a first lower portion thereof and being connected to the cleaner body section by a flexible hose, the dirt-collecting section being formed at a rear wall thereof with a pair of first guide holes, each pair of first guide holes being provided at a first upper portion thereof with a pair of suspension plates which are extended toward an interior of the dirt-collecting section in such a manner that suspension plates are faced with each other, each suspension plate having a hinge pin at the center thereof;

a coupler assembly for coupling the cleaner body section to the dirt-collecting section, the coupler assembly including an upper case which is integrally formed at a second upper portion thereof with a first fork portion, a lower case which is assembled into the upper case by bolts and is integrally formed at a third upper portion thereof with a second fork portion, a frame which is disposed between the upper case and the lower case and is integrally formed at a fourth upper portion thereof with a third fork portion, and a lever assembly disposed between the upper case and the frame, the first fork portion being provided with a pair of first semi-cylindrical head portions at a first terminal end thereof, the second fork portion being provided with a pair of second semi-cylindrical head portions at a second terminal end thereof, the pair of second semi-cylindrical head portions being incorporated with the first semi-cylindrical head portions so as to form a pair of first cylindrical head portions, the third fork portion being provided with a pair of second cylindrical head portions at a third terminal end thereof, the pair of second cylindrical head portions being accommodated in the first cylindrical head portions, the first, second and third fork portions being declined at an predetermined angle with respect to the upper case, the lower case and the frame, respectively, the upper case being formed at second lower side walls thereof with a first cutting portion respectively, the lower case being formed at third lower side walls thereof with a second cutting portion respectively, the second cutting portion being incorporated with the first cutting portion so as to form a rectangular hole, the frame being formed at a second lower portion thereof with an elongated guide groove, the elongated guide groove being disposed in correspondence to the rectangular hole, the lever assembly including a torsion spring having an annular portion and a pair of leg portions, a pair of sleeves securely engaged with the leg portions, and a pair of sliders, each slider having insert hole thereon into which end parts of the leg portions are inserted, each slider being slidably seated in the elongated guide groove, the torsion spring biasing sliders to an exterior of the coupler assembly so that sliders are inserted into engagement holes of the receptacle through the rectangular hole as the coupler assembly is received in the receptacle, the frame having a protuberance ring for suspending the lever assembly, the protuberance ring being engaged with the annular portion of the torsion spring, the first and second cylindrical heads having a pair of first and second pin holes respectively, each hinge pin being inserted into the first and second pin holes, the lower case being formed with a pair of second guide holes, the frame being formed with a pair of third guide holes, each sleeve being disposed longitudinally across each third guide hole, each first cylindrical head having a convex portion;

a pair of protuberances having a slope portion at a front portion thereof respectively, slope portion being slide-contacted with the sleeve, the pair of protuberances being integrally formed with the rear wall of the dirt-collecting section and disposed below first guide holes, the pair of protuberances being disposed in correspondence to second and third guide holes so as to enter into the coupler assembly; and a pair of leaf springs secured to the dirt-collecting section by a bolt and extended downward along the pair of first guide holes, each leaf spring having a concave portion, the concave portion being detachably engaged with the concave portion.

19. A vacuum cleaner comprising:

a cleaner body section including a drum and a pair of wheels provided at both side walls of the drum, the drum having a receptacle at a front portion thereof, the receptacle being provided at first lower side walls thereof with an engagement hole respectively;

a dirt-collecting section for sucking and collecting a dirt, the dirt-collecting section having a brush head at a first lower portion thereof and being connected to the cleaner body section by a flexible hose, the dirt-collecting section being formed at a rear wall thereof with a pair of first guide holes, the dirt-collecting section having a hanger provided between first guide holes;

a coupler assembly for coupling the cleaner body section to the dirt-collecting section, the coupler assembly including an upper case which is integrally formed at a first upper portion thereof with a first fork portion, a lower case which is assembled into the upper case by bolts and is integrally formed at a second upper portion thereof with a second fork portion, a frame which is disposed between the upper case and the lower case and is integrally formed at a third upper portion thereof with a third fork portion, and a pair of lever assemblies disposed between the lower case and the frame, the upper case being provided at second lower side walls thereof with a first semi-circular aperture respectively, the upper case being provided at first upper side walls thereof with a second semi-circular aperture respectively, the lower case being provided at third lower side walls thereof with a third semi-circular aperture respectively, the lower case being provided at second upper side walls thereof with a fourth semi-circular aperture respectively, the frame being formed at a lower portion thereof with a semi-circular elongated guide groove communicated with the first semi-circular aperture, the first semi-circular aperture being incorporated with the third semi-circular aperture so as to form a first circular hole, the second semi-circular aperture being incorporated with the fourth semi-circular aperture so as to form a second circular hole, the first, second and third fork portions being declined at an predetermined angle with respect to the upper case, the lower case and the frame, respectively, the second fork portion being formed with a pair of guide passages for receiving the third fork portion, the second fork portion being inserted in first guide holes, the upper case being provided at a first upper inner wall thereof with a pair of first pin holders, the lower case being provided at a second upper inner wall thereof with a pair of second pin holders which are disposed in correspondence to the pair of first pin holders, the frame being provided at a first inner wall thereof with a support member for supporting lever assemblies, each lever assembly including an arm portion, a hinge pin which passes through a fourth upper portion of the arm portion, a torsion spring closely wound around the hinge pin, and a slider, the torsion spring including a first leg portion and a second leg portion which is longer than the first leg portion, the slider being securely engaged with a terminal end of the second leg portion of the torsion spring, the arm portion being provided at a third lower portion thereof with a slide-contact portion, the hinge pin having a first and second ends securely inserted into the first and second pin holders respectively, the slider being slidably seated in the semi-circular elongated guide groove, the torsion spring biasing the slider to an exterior of the coupler assembly so that slider is inserted into engagement hole of the receptacle through the first circular hole as the coupler assembly is received in the receptacle, the frame being formed at the third upper portion thereof with a second and third perforation openings which are disposed in opposition to each other and communicated with first circular holes respectively, the third perforation opening being formed at a second inner wall thereof with an internal screw, the lower case being formed with a pair of second guide holes;

a screw shaft formed at one end thereof with a screw portion, the screw shaft being screw-coupled into the third perforation opening by way of the second circular hole, the second perforation opening, and the first perforation opening of the hanger, so that the coupler assembly is pivotally coupled to the rear wall of the dirt collecting section;

a pair of protuberances having a slope portion at a front portion thereof respectively, slope portion being slide-contacted with the slide-contact portion of the lever assembly, the pair of protuberances being integrally formed with the rear wall of the dirt-collecting section and disposed below first guide holes, the pair of protuberances being disposed in correspondence to second guide holes so as to enter into the coupler assembly;

a support plate formed integrally with an inner surface of the rear wall of the dirt-collecting section; and a pair of leaf springs secured to the support plate by a bolt and extended upward along the pair of first guide holes, each leaf spring having a first and second concave portions, the convex portion being alternatively engaged with the first and second concave portions.

* * * * *